US008033421B2

(12) United States Patent
Cowell et al.

(10) Patent No.: US 8,033,421 B2
(45) Date of Patent: Oct. 11, 2011

(54) REFILLABLE TRAVEL DISPENSER FOR WET WIPES

(75) Inventors: Christine Marie Cowell, Neenah, WI (US); Robert Samuel Schlaupitz, New London, WI (US); Kevin C. Possell, Middleton, WI (US); Jason Robert Boon, Appleton, WI (US); Daphne Lynn VanBuren, Greenville, WI (US); Erica Marie Golub, Fond du Lac, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 24 days.

(21) Appl. No.: 11/866,914

(22) Filed: Oct. 3, 2007

(65) Prior Publication Data

US 2009/0090736 A1 Apr. 9, 2009

(51) Int. Cl.
*B65H 1/00* (2006.01)
*B65D 73/00* (2006.01)

(52) U.S. Cl. ..... 221/63; 221/45; 221/61; 221/47; 206/494; 206/449; 206/541; 206/57; 206/37; 206/39.7; 220/259.1; 220/835

(58) Field of Classification Search ..... 220/259.1, 220/835; 206/57, 494, 449, 541, 37, 39.7; 221/45, 63, 61, 47
See application file for complete search history.

(56) References Cited

U.S. PATENT DOCUMENTS

| | | | | |
|---|---|---|---|---|
| 1,626,311 | A | | 4/1927 | Tipton |
| 1,883,852 | A | * | 10/1932 | Medoff ..... 206/449 |
| 1,889,012 | A | | 11/1932 | Berger |
| 1,953,887 | A | * | 4/1934 | Medoff ..... 206/37 |
| 2,264,300 | A | | 12/1941 | Davies |
| 2,287,530 | A | | 6/1942 | Morando |
| 2,460,306 | A | * | 2/1949 | Patterson ..... 206/37 |
| 3,338,992 | A | | 8/1967 | Kinney |
| 3,341,394 | A | | 9/1967 | Kinney |
| 3,485,706 | A | | 12/1969 | Evans |
| 3,502,763 | A | | 3/1970 | Hartman |
| 3,542,615 | A | | 11/1970 | Dobo et al. |
| 3,560,326 | A | | 2/1971 | Bunting, Jr. et al. |
| 3,692,618 | A | | 9/1972 | Dorerschner et al. |
| 3,747,802 | A | | 7/1973 | Uroshevich |
| 3,780,908 | A | | 12/1973 | Fitzpatrick et al. |
| 3,802,817 | A | | 4/1974 | Matsuki et al. |
| 3,849,241 | A | | 11/1974 | Butin et al. |
| 3,967,756 | A | | 7/1976 | Barish |

(Continued)

FOREIGN PATENT DOCUMENTS

JP 03065231 10/1999

(Continued)

OTHER PUBLICATIONS

International Search Report and Written Opinion regarding application PCT/IB2008/053981, dated Jan. 28, 2009.

*Primary Examiner* — Gene O. Crawford
*Assistant Examiner* — Rakesh Kumar
(74) *Attorney, Agent, or Firm* — Armstrong Teasdale LLP

(57) ABSTRACT

A dispenser configured to close and fold into a small, compact, refillable package for storing personal care products is disclosed. Specifically, the dispenser has significantly less surface area in the closed (i.e., folded) position as compared to the unfolded personal care product that is stored within the dispenser.

6 Claims, 24 Drawing Sheets

U.S. PATENT DOCUMENTS

| | | | | | |
|---|---|---|---|---|---|
| D244,583 | S | | 6/1977 | Barish | |
| 4,100,324 | A | | 7/1978 | Anderson et al. | |
| 4,131,195 | A | * | 12/1978 | Worrell, Sr. | 206/205 |
| 4,340,563 | A | | 7/1982 | Appel et al. | |
| 4,524,871 | A | * | 6/1985 | Klinger | 206/233 |
| 4,553,665 | A | | 11/1985 | Weock et al. | |
| 4,586,630 | A | * | 5/1986 | Loder | 221/46 |
| 4,684,017 | A | | 8/1987 | Watanabe et al. | |
| 4,735,317 | A | | 4/1988 | Sussman et al. | |
| D295,630 | S | | 5/1988 | Wells-Papanek et al. | |
| 4,971,220 | A | | 11/1990 | Kaufman et al. | |
| 5,137,600 | A | | 8/1992 | Barnes et al. | |
| 5,145,088 | A | * | 9/1992 | Goujon | 220/837 |
| 5,145,091 | A | | 9/1992 | Meyers | |
| 5,213,881 | A | | 5/1993 | Timmons | |
| 5,284,703 | A | | 2/1994 | Everhart et al. | |
| 5,350,624 | A | | 9/1994 | Geoger et al. | |
| 5,364,382 | A | | 11/1994 | Latimer | |
| D365,755 | S | | 1/1996 | Kanfer et al. | |
| 5,486,166 | A | | 1/1996 | Bishop et al. | |
| 5,490,846 | A | | 2/1996 | Ellis et al. | |
| D367,609 | S | | 3/1996 | Frank et al. | |
| 5,531,325 | A | * | 7/1996 | Deflander et al. | 206/494 |
| 5,542,567 | A | * | 8/1996 | Julius | 221/63 |
| 5,544,750 | A | * | 8/1996 | Randall | 206/494 |
| 5,573,132 | A | | 11/1996 | Kanfer et al. | |
| 5,605,227 | A | * | 2/1997 | Morita | 206/387.1 |
| 5,667,092 | A | * | 9/1997 | Julius et al. | 220/259.1 |
| 5,743,405 | A | * | 4/1998 | Reid | 206/541 |
| D396,329 | S | | 7/1998 | Litton et al. | |
| D398,079 | S | | 9/1998 | Denison | |
| 5,980,931 | A | | 11/1999 | Fowler et al. | |
| D421,901 | S | | 3/2000 | Hill | |
| D421,902 | S | | 3/2000 | Hill | |
| D422,081 | S | | 3/2000 | Wolff | |
| 6,102,247 | A | * | 8/2000 | Crawford | 221/61 |
| 6,116,501 | A | * | 9/2000 | Hupp | 229/125.09 |
| 6,121,165 | A | | 9/2000 | Mackey et al. | |
| 6,164,821 | A | * | 12/2000 | Randall | 383/34 |
| D443,450 | S | | 6/2001 | Ruhotas et al. | |
| D443,508 | S | | 6/2001 | Braaten et al. | |
| D446,012 | S | | 8/2001 | Ashiwa et al. | |
| D450,960 | S | | 11/2001 | Boyea et al. | |
| 6,325,239 | B2 | * | 12/2001 | Randall et al. | 220/835 |
| D454,015 | S | | 3/2002 | Okin et al. | |
| 6,375,225 | B1 | | 4/2002 | Lapsker | |
| D461,403 | S | | 8/2002 | Chomik et al. | |
| D471,440 | S | | 3/2003 | Sams et al. | |
| D473,740 | S | | 4/2003 | Ruhotas et al. | |
| 6,550,635 | B1 | | 4/2003 | King | |
| 6,609,616 | B2 | | 8/2003 | Dilnik | |
| D479,419 | S | | 9/2003 | White et al. | |
| D479,420 | S | | 9/2003 | White et al. | |
| D485,461 | S | | 1/2004 | Sams et al. | |
| 6,673,358 | B1 | | 1/2004 | Cole et al. | |
| 6,774,069 | B2 | | 8/2004 | Zhou et al. | |
| D495,545 | S | | 9/2004 | Niehues | |
| D495,910 | S | | 9/2004 | Zaidman | |
| 6,872,784 | B2 | | 3/2005 | Zhou et al. | |
| D506,132 | S | | 6/2005 | De-Vries | |
| 6,946,413 | B2 | | 9/2005 | Lange et al. | |
| 6,958,103 | B2 | | 10/2005 | Anderson et al. | |
| 6,960,349 | B2 | * | 11/2005 | Shantz et al. | 424/402 |
| 7,017,776 | B1 | * | 3/2006 | Hupp | 220/834 |
| 7,073,684 | B2 | * | 7/2006 | Decker et al. | 221/63 |
| RE39,307 | E | | 9/2006 | Zhou et al. | |
| 7,232,040 | B2 | * | 6/2007 | Decker et al. | 221/61 |
| 7,416,083 | B2 | * | 8/2008 | Bando | 206/494 |
| 7,686,165 | B2 | * | 3/2010 | Aldridge et al. | 206/449 |
| 7,699,166 | B2 | * | 4/2010 | Gauger et al. | 206/233 |
| 2006/0008621 | A1 | | 1/2006 | Gusky et al. | |

FOREIGN PATENT DOCUMENTS

| | | | |
|---|---|---|---|
| JP | 2002160746 | A | 6/2002 |
| JP | 03134923 | | 8/2007 |
| KR | 10-2003-0007626 | | 1/2003 |
| KR | 20-0408035 | | 2/2006 |
| WO | 9633111 | A1 | 10/1996 |
| WO | 03008300 | | 1/2003 |

* cited by examiner

REFILLABLE TRAVEL DISPENSER FOR WET WIPES

BACKGROUND OF DISCLOSURE

The present disclosure generally relates to a refillable travel dispenser for personal care products, particularly for sheeted personal care products, including wet wipes, facial tissue, toilet tissue, and the like. Specifically, the dispenser is configured to close and fold into a small, compact, refillable package for storing personal care products. The dispenser has significantly less surface area in the closed (i.e., folded) position as compared to the unfolded personal care product that is stored within the dispenser. Furthermore, clips are used within the internal compartment of the dispenser to hold the personal care products neatly within the internal compartment of the dispenser and to allow for consistent dispensing of the personal care product.

Dispensers for wet wipes and other such substrates come in a wide variety of types and styles. Frequently, there is a consumer desire to have a dispenser that is highly portable and suitable for placement in the car, home, a purse, a diaper bag, or other luggage. Many existing travel sized products or dispensers often either lack the ability to refill or require a special purchase of a refill cartridge because they cannot be used with the product or dispenser the consumer already uses at home without significant product manipulation (e.g., folding or wadding the product into a smaller size). Furthermore, many of these travel dispensers and other dispensers that do offer refilling from home products are often not small enough and are inconvenient to carry, especially when a diaper bag is not being used. For example, conventional dispensers typically have a surface area of at least about 130 to about 150% of the surface area of the product that is stored within the dispenser.

Additionally, there may be dispensers that are small enough to be used in a portable manner. However, these portable dispensers can open inadvertently subjecting the contents of the dispenser to dirt, contamination, or even having the wet wipes fall out, ruining the contents. This can be especially true if the dispenser is accidentally dropped, and thereafter impacts a hard surface such as a floor. Thus, it is important that the dispenser have a secure closure to keep the contents from inadvertently spilling. Yet, at the same time, the contents of the dispenser need to be readily accessible without an undue struggle to access the wet wipes when needed. Frequently, wet wipes are used to clean up spills or during diapering of a child. The dispenser's ease of use is important for these tasks when speed or the capability to open the dispenser using only one hand is an advantage.

As such, there is a need for a small refillable travel dispenser for personal care products, such as wet wipes. The dispenser should be capable of being refilled using the products already used in the home. Additionally, the dispenser should further securely maintain the products within the dispenser while at the same time provide ready access to the products when needed.

SUMMARY OF THE DISCLOSURE

It has been found that refillable travel dispensers for personal care products such as wet wipes can be configured to close and fold into a small, compact, refillable package to conveniently fit within a purse or other travel luggage. Specifically, the dispenser has an equal to or smaller surface area in the closed (i.e., folded) position as compared to the unfolded personal care product that is stored within the dispenser. Furthermore, clips are used within the internal compartment of the dispenser to hold the personal care products neatly within the internal compartment of the dispenser.

As such, the present disclosure is directed to a dispenser comprising: a container having an internal compartment for holding a personal care product. The dispenser comprises at least one hinge disposed on an external lateral edge of the container and configured for folding the container into a closed position and a latching device configured for holding the container in the closed position. A personal care product is disposed within the internal compartment of the container in a full, flat orientation (i.e., unfolded) when in an open position and the container is configured to permit removal of the personal care product from the internal compartment when in the open position. The container has a surface area when in the closed position of no greater than about 100% of the surface area of the personal care product in the full, flat orientation.

The present disclosure is further directed to a dispenser comprising: a flexible container having an internal compartment for holding a wet wipe; at least one hinge disposed on an external lateral edge of the container and configured for folding the container into a closed position; and a latching device configured for holding the container in the closed position. A wet wipe is disposed within the internal compartment of the container in a full, flat orientation when in an open position and the container is configured to permit removal of the wet wipe from the internal compartment when in the open position. The container has a surface area when in the closed position of no greater than about 100% of the surface area of the wet wipe in the full, flat orientation.

The present disclosure is further directed to a dispenser comprising: a rigid plastic container having an internal compartment for containing a wet wipe; at least one hinge disposed on an external lateral edge of the container, wherein the hinge is configured for folding the container into a closed position; and a latching device configured for holding the container in the closed position. A wet wipe is disposed within the internal compartment of the container when in an open container in a full, flat orientation and the container is configured to permit removal of the wet wipe from the internal compartment. The container has a surface area when in the closed position of no greater than about 100% of the surface area of the wet wipe in the full, flat orientation.

Other objects and features will be in part apparent and in part pointed out hereinafter.

BRIEF DESCRIPTION OF THE DRAWINGS

Corresponding reference characters indicate corresponding parts throughout the drawings.

DEFINITIONS

Figure 1A:
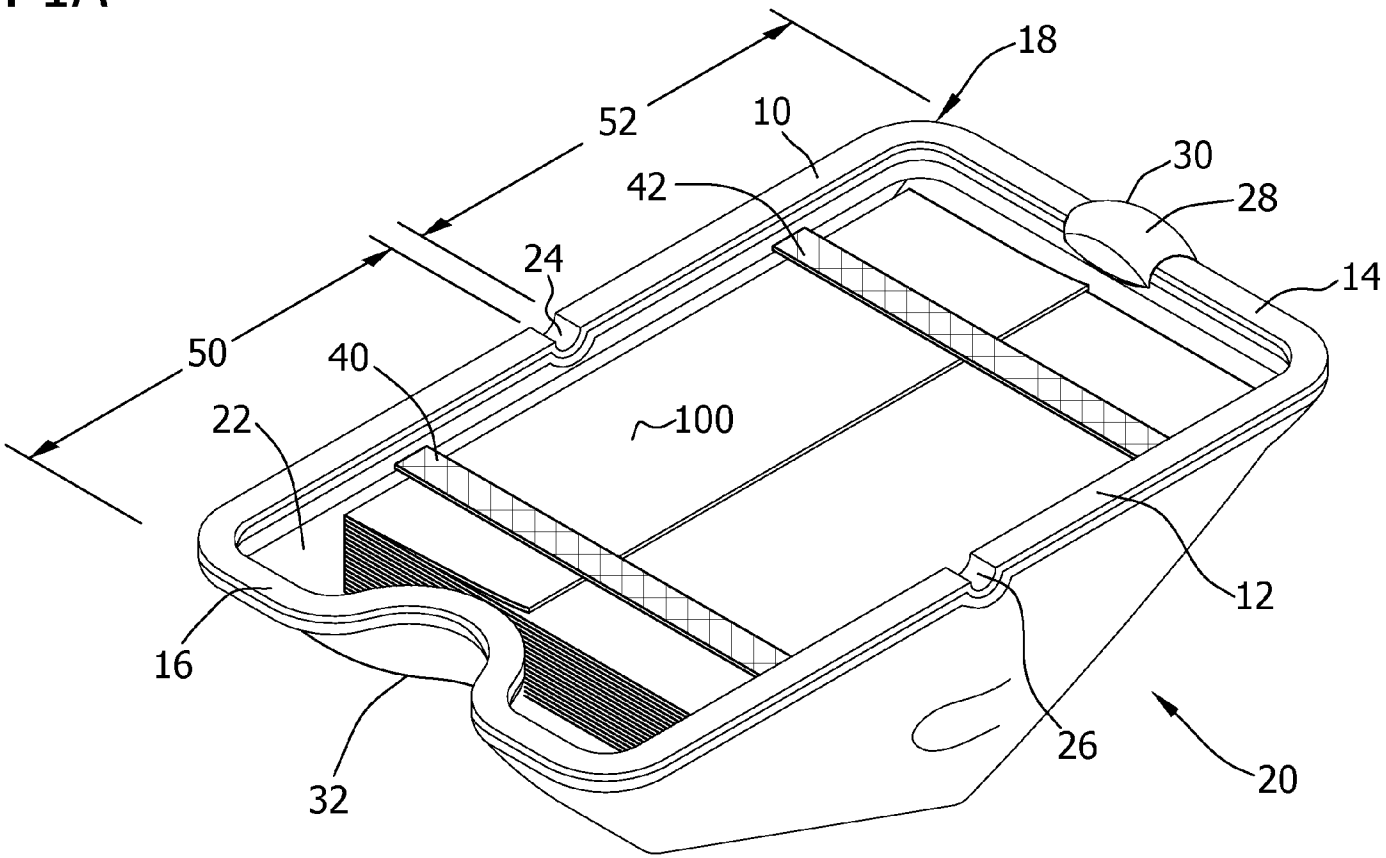
FIG. 1*a* is a view of a first representative embodiment of a dispenser of the present disclosure.

Within the context of this specification, each term or phrase below includes the following meaning or meanings:

As used herein, "substrate" is a flexible sheet or web material, which is useful for household chores, personal care, health care, food wrapping, cosmetic application or removal, and the like. Non-limiting examples of suitable substrates of the present disclosure include nonwoven substrates, woven substrates, hydro-entangled substrates, air-entangled substrates, paper substrates comprising cellulose such as facial tissue, toilet paper, or paper towels, waxed paper substrates, coform substrates, wet wipes, film or plastic substrates such as those used to wrap food, and metal substrates such as aluminum foil. Further examples of suitable substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931, issued to Fowler, et al. (Nov. 9, 1999). Other suitable substrates may have encapsulated ingredients such that the capsules rupture during dispensing or use. Other suitable substrates include dry substrates that deliver liquid when subjected to in-use shear and compressive forces. Such substrates are disclosed in U.S. Pat. No. 6,121,165, issued to Mackay, et al. (Sep. 19, 2000). While, wet and dry substrates have been defined herein, it should be understood that the substrates for use in the personal care products can be any substrate having a moisture content in between the defined wet and dry substrate. Furthermore, the substrates can be treated or untreated. When treated, the substrates can be treated with any solution known in the art such as oil, water, solvent, lotion, and the like. Furthermore, laminated or plied together substrates of two or more layers of any of the preceding substrates are suitable. Even more suitable substrates can include materials such as leather, suede, fabrics, and the like.

"Airlaid" refers to a porous web formed by dispersing fibers in a moving air stream prior to collecting the fibers on a forming surface. The collected fibers are then typically bonded to one another using, for example, hot air or a spray adhesive. Suitable examples of airlaid webs can be found in U.S. Pat. No. 5,486,166 to Bishop, et al. and U.S. Publication No. 2006/0008621 to Gusky, et al.

"Bonded-carded web" refers to a web made from staple fibers sent through a combing or carding unit, which separates or breaks apart and aligns the fibers to form a nonwoven web. For example, the web may be a powder bonded carded web, an infrared bonded carded web, or a through-air bonded carded web. Examples of such materials may be found in U.S. Pat. No. 5,490,846 to Ellis et al.; U.S. Pat. No. 5,364,382 to Latimer; and U.S. Pat. No. 6,958,103 to Anderson, et al.

"Clip" or "Clips" refers to any material, device or mechanism located within or over the internal compartment of the container that is capable of containing or holding the personal care products within the internal compartment of the container during storage and can further aid in consistent single dispensing of the personal care product from the internal compartment prior to use of the personal care product. Additionally, the clips may reduce the exposure of the personal care products to contaminants such as dirt and, in some cases, the clips can aid in moisture retention such as when the personal care products are wet wipes. The clip can also be referred to herein as a "containment mechanism."

"Closed" or "Closed position" refers to the configuration of the dispenser once the dispenser has been folded along a hinge or crease or otherwise manipulated to have a reduced surface area.

"Coform" refers to a blend of meltblown fibers and absorbent fibers such as cellulosic fibers that can be formed by air forming a meltblown polymer material while simultaneously blowing air-suspended fibers into the stream of meltblown fibers. The coform material may also include other materials, such as superabsorbent materials. The meltblown fibers and absorbent fibers are collected on a forming surface, such as provided by a belt. The forming surface may include a gas-pervious material that has been placed onto the forming surface. Two U.S. patents describing coform materials are U.S. Pat. No. 4,100,324 to Anderson et al. and U.S. Pat. No. 5,350,624 to Georger et al., both of which are incorporated in their entirety in a manner consistent herewith.

"Disposable" refers to articles that are designed to be discarded after a limited use rather than being restored for reuse.

The terms "disposed on," "disposed along," "disposed with," or "disposed toward" and variations thereof are intended to mean that one element can be integral with another element, or that one element can be a separate structure bonded to or placed with or placed near another element.

"Hinge" refers to any device or mechanism that allows the dispenser to be folded into a closed position or position capable of reducing the surface area of the dispenser. For example, the hinge can be a living hinge having a moving component such as a spring device. Other hinges suitable for use in the present disclosure can include pins, pivots, knuckles, and the like, as known in the art. Alternatively, the hinge can be a fold or crease in the container in which the container is folded over into the closed position.

"Layer" when used in the singular can have the dual meaning of a single element or a plurality of elements.

"Meltblown" refers to fibers formed by extruding a molten thermoplastic material through a plurality of fine, usually circular, die capillaries as molten threads or filaments into converging high velocity gas (e.g., air) streams, generally heated, which attenuate the filaments of molten thermoplastic material to reduce their diameters. Thereafter, the meltblown fibers are carried by the high velocity gas stream and are deposited on a collecting surface or support to form a web of randomly dispersed meltblown fibers. Such a process is disclosed, for example, in U.S. Pat. No. 3,849,241 to Butin et al. Meltblowing processes can be used to make fibers of various dimensions, including macrofibers (with average diameters from about 40 to about 100 microns), textile-type fibers (with average diameters between about 10 and 40 microns), and microfibers (with average diameters less than about 10 microns). Meltblowing processes are particularly suited to making microfibers, including ultra-fine microfibers (with an average diameter of about 3 microns or less). A description of an exemplary process of making ultra-fine microfibers may be found in, for example, U.S. Pat. No. 5,213,881 to Timmons, et al. Meltblown fibers may be continuous or discontinuous and are generally self bonding when deposited onto a collecting surface.

"Nonwoven" and "nonwoven web" refer to materials and webs of material that are formed without the aid of a textile weaving or knitting process. For example, nonwoven materials, fabrics or webs have been formed from many processes such as, for example, meltblowing processes, spunbonding processes, air laying processes, coform processes, and bonded carded web processes.

"Open," "Opened" or "Open position" refers to the configuration of the dispenser in a full, flat orientation; that is, prior to the dispenser being folded along a hinge or crease or otherwise manipulated to have a reduced surface area. Furthermore, the open position is the position in which the consumer or user would likely be dispensing the personal care products from the dispensing opening.

"Surface area" refers to the two-dimensional external (length×width) surface area of the top surface of the container in the closed position and/or the personal care product in the full, flat orientation. A third dimension, which is not included in calculating this surface area, is the thickness of the personal care product to be stored in the container or the depth of the container itself. This third dimension will be optimized depending upon the personal care product and its intended use. It is directly related to the number, thickness, and size of wipes intended for use in the container.

"Spunbonded fibers" refers to small diameter fibers which are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the contents of which are incorporated herein by reference in their entirety. Spunbond fibers are generally continuous and have diameters generally greater than about 7 microns, more particularly, between about 10 and about 20 microns.

"Spunlace" refers to a means of bonding a web and involves entangling the fibers with high-pressure liquid jets along closely-spaced parallel lines. There are typically no bonding agents involved. Examples of spunlace materials include those described in U.S. Pat. No. 3,560,326 to Bunting, Jr., et al. and U.S. Pat. No. 3,485,706 to Evans.

"Hydroknit" is another means of bonding a wet-laid web, wherein the web is hydraulically needled, such as described in U.S. Pat. No. 5,137,600 to Barnes, et al; U.S. Pat. No. 5,284,703 to Everhart, et al.; and U.S. Pat. No. 6,673,358 to Cole, et al.

"Elastic" refers to any material, including a film, fiber, nonwoven web, or combination thereof, which upon application of a biasing force in at least one direction, is stretchable to a stretched, biased length which is at least about 110 percent, suitably at least about 130 percent, and particularly at least about 150 percent, its relaxed, unstretched length, and which will recover at least 15 percent of its elongation upon release of the stretching, biasing force. In the present application, a material need only possess these properties in at least one direction to be defined as elastic.

As used herein, the terms "elastomer" or "elastomeric" refer to polymeric materials that have properties of stretchability and recovery.

"Polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

Figure 14A:
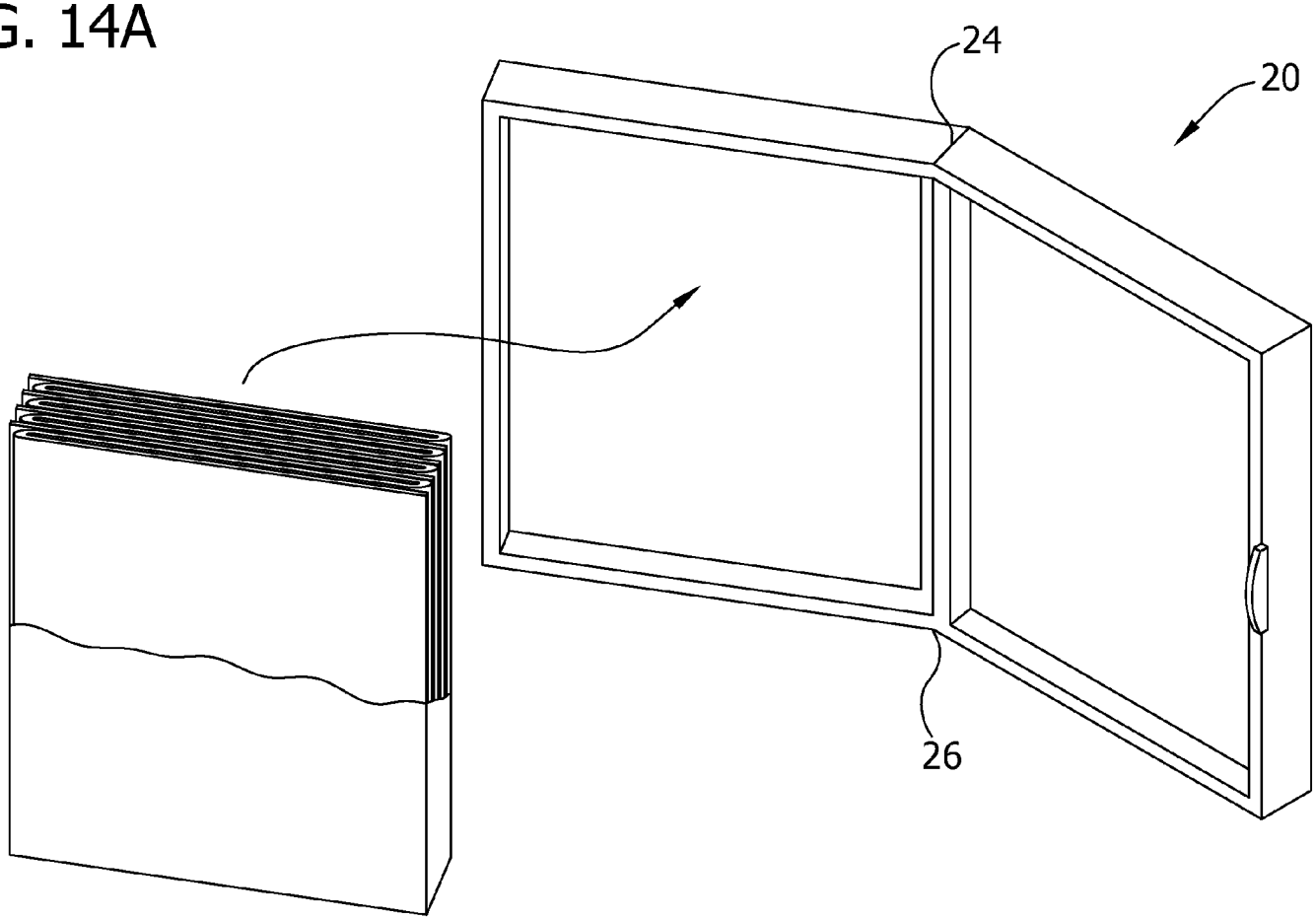
FIG. 14*a* is a view of a fourteenth representative embodiment of a dispenser of the present disclosure and an unfolded stack of wet wipes for use in the dispenser.
Figure 14B:
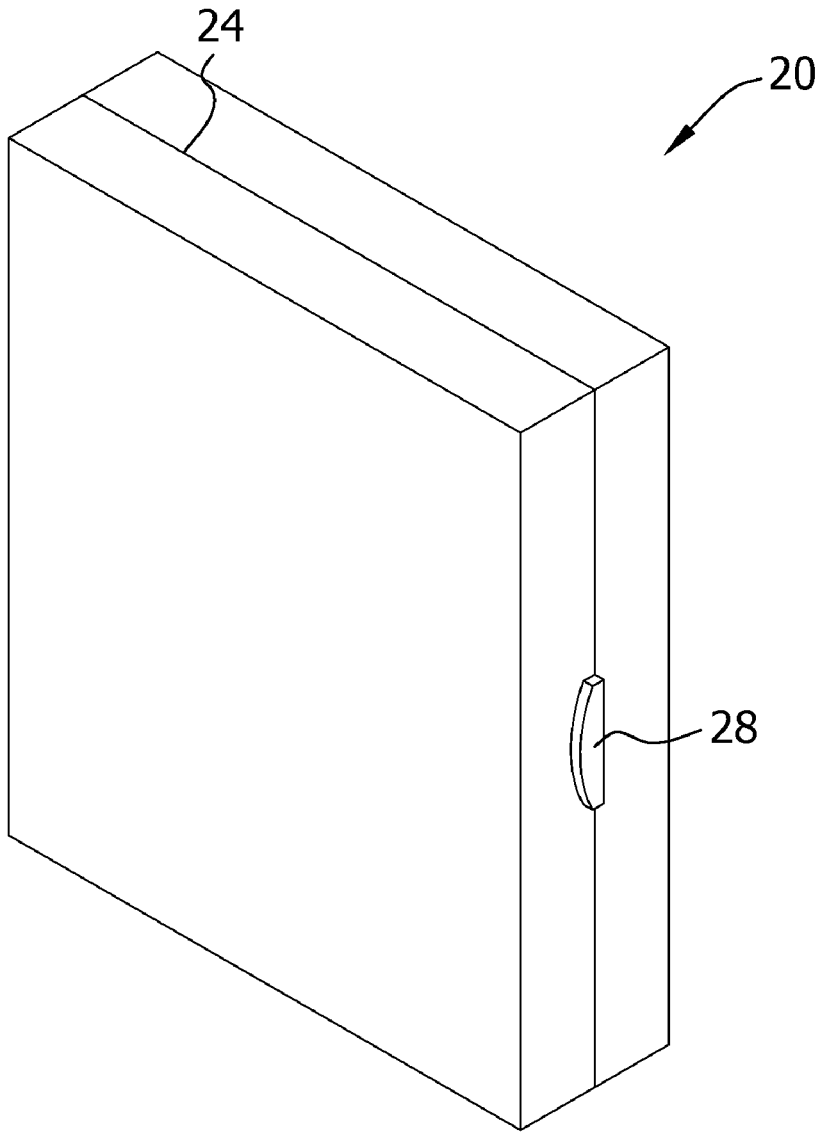
FIG. 14*b* is a view of the dispenser in FIG. 14*a* in the closed (i.e., folded) position.

"Unfolded" or "full, flat orientation" refers to the configuration of the personal care product when there has only been folding or manipulation of the product by the manufacturer; that is, there has been no additional manipulation of the product by the consumer. Specifically, wipes typically are produced and delivered to the consumer with at least one inherent fold, such as either a "Z", "C", or "W" fold. When the wipe has no additional manipulation, such as by the consumer or user, the wipe is said to be in an unfolded or full, flat orientation. By way of example, FIG. 14 depicts a stack of wipes having a "Z" fold, but otherwise being in the unfolded or full, flat orientation for use in the dispenser of the present disclosure.

"Wet wipe" refers to a wipe that includes greater than about 70% (by weight substrate) moisture content. "Dry wipe" refers to a wipe that includes less than about 10% (by weight substrate) moisture content.

These terms may be defined with additional language in the remaining portions of the specification.

DETAILED DESCRIPTION OF THE DISCLOSURE

The present disclosure is generally related to a refillable dispenser that is configured to provide convenient carrying and ease of use, dispensing, and refilling. Specifically, the refillable travel dispenser is configured to close and fold into a small, compact, refillable package for storing personal care products, typically disposable personal care products. The dispenser has equal or less surface area in the closed (i.e., folded) position as compared to the unfolded personal care product that is stored within the dispenser.

Specifically, the dispenser comprises a container having an internal compartment for personal care products. One particularly preferred personal care product in which the dispenser is suitable for storing are sheeted product such as wipes. Generally, the wipes stored in the dispensers of the present disclosure can be wet wipes, dry wipes, or anywhere in between. More specifically, suitable wipes for use in the present disclosure can include wet wipes, flushable moist wipes, hand wipes, face wipes, cosmetic wipes, household wipes, industrial wipes, baby wipes, facial tissues, toilet tissues, napkins, and the like. Particularly preferred wipes are wet wipes, baby wipes, and flushable moist wipes, and other wipe-types that include a wetting solution.

Materials suitable for the substrate of the wipes are well known to those skilled in the art, and are typically made from a fibrous sheet material which may be either woven or nonwoven. For example, suitable materials for use in the wipes may include nonwoven fibrous sheet materials which include meltblown, coform, air-laid, bonded-carded web materials, hydroentangled materials such as spunlace materials, and combinations thereof. Such materials can be comprised of synthetic or natural fibers, or a combination thereof. Typically, the wipes of the present disclosure define a basis weight of from about 25 grams per square meter to about 125 grams per square meter and desirably from about 35 grams per square meter to about 80 grams per square meter. In one particular embodiment, the wipes of the present disclosure comprise a coform basesheet of polymer fibers and absorbent fibers having a basis weight of from about 55 to about 80 grams per square meter and desirably from about 60 to about 70 grams per square meter. Such coform basesheets are manufactured generally as described in U.S. Pat. No. 4,100,324, issued to Anderson, et al. (Jul. 11, 1978); U.S. Pat. No. 5,284,703, issued to Everhart, et al. (Feb. 8, 1994); and U.S. Pat. No. 5,350,624, issued to Georger, et al. (Sep. 27, 1994), the disclosures of which are incorporated by reference to the extent to which they are consistent herewith. Typically, such coform basesheets comprise a gas-formed matrix of thermoplastic polymeric meltblown fibers and cellulosic fibers. Various suitable materials may be used to provide the polymeric meltblown fibers, such as, for example, polypropylene microfibers. Alternatively, the polymeric meltblown fibers may be elastomeric polymer fibers, such as those provided by a polymer resin. For instance, Vistamaxx® elastic olefin copolymer resin designated PLTD-1810, available from ExxonMobil Corporation (Houston, Tex.) or KRATON G-2755, available from Kraton Polymers (Houston, Tex.) may be used to provide stretchable polymeric meltblown fibers for the coform basesheets. Other suitable polymeric materials or combinations thereof may alternatively be utilized as known in the art.

As noted above, the coform basesheet additionally may comprise various absorbent cellulosic fibers, such as, for example, wood pulp fibers. Suitable commercially available cellulosic fibers for use in the coform basesheets can include, for example, NF 405, which is a chemically treated bleached southern softwood Kraft pulp, available from Weyerhaeuser Co. of Federal Way (Wash.); NB 416, which is a bleached southern softwood Kraft pulp, available from Weyerhaeuser Co.; CR-0056, which is a fully debonded softwood pulp, available from Bowater, Inc. (Greenville, S.C.); Golden Isles 4822 debonded softwood pulp, available from Koch Cellulose (Brunswick, Ga.); and SULPHATATE HJ, which is a chemically modified hardwood pulp, available from Rayonier, Inc. (Jesup, Ga.).

The relative percentages of the polymeric meltblown fibers and cellulosic fibers in the coform basesheet can vary over a wide range depending upon the desired characteristics of the wipes. For example, the coform basesheet may comprise from about 10 weight percent to about 90 weight percent, desirably from about 20 weight percent to about 60 weight percent, and more desirably from about 25 weight percent to about 35 weight percent of the polymeric meltblown fibers based on the dry weight of the coform basesheet being used to provide the wipes.

In an alternative embodiment, the wipes of the present disclosure can comprise a composite which includes multiple layers of materials. For example, the wipes may include a three layer composite which includes an elastomeric film or meltblown layer between two coform layers as described above. In such a configuration, the coform layers may define a basis weight of from about 15 grams per square meter to about 30 grams per square meter and the elastomeric layer may include a film material such as a polyethylene metallocene film. Such composites are manufactured generally as described in U.S. Pat. No. 6,946,413, issued to Lange, et al. (Sep. 20, 2005), which is hereby incorporated by reference to the extent it is consistent herewith.

While, the present disclosure has discussed using coform as the major component of wipes for use in the dispenser of the present disclosure, it should be understood by one skilled in the art that the wipes and personal care products may be made from any suitable material known in the art. For example, suitable wipes can be made using airlaid materials, such as described in U.S. Pat. No. 6,960,349, issued to Shantz, et al. (Nov. 1, 2005), which is incorporated by reference to the extent that it is consistent herewith. Furthermore, materials such as spunlace and hydroentangled materials may also be used.

As noted above, one particularly preferred personal care product is a wet wipe. The wetting solution in the wet wipe can be any wetting solution known to one skilled in the wet wipe art. Generally, the wetting solution can include water, emollients, surfactants, preservatives, chelating agents, pH adjusting agents, skin conditioners, fragrances, and combinations thereof. For example, one suitable wetting solution for use in the wet wipe stored in the dispensers of the present disclosure comprises about 98% (by weight) water, about 0.6% (by weight) surfactant, about 0.3% (by weight) humectant, about 0.3% (by weight) emulsifier, about 0.2% (by weight) chelating agent, about 0.35% (by weight) preservative, about 0.002% (by weight) skin conditioning agent, about 0.03% (by weight) fragrance, and about 0.07% (by weight) pH adjusting agent. One specific wetting solution suitable for use in the wet wipe is described in U.S. Pat. No. 6,673,358, issued to Cole et al. (Jan. 6, 2004), which is incorporated herein by reference to the extent it is consistent herewith.

Other personal care products that can be used in the dispenser of the present disclosure include, for example, tissue paper products such as facial tissue, toilet tissue, napkins, and the like.

In one embodiment, the container is made of a rigid or semi-rigid plastic material such as polyolefins, styrenics, or other semi-rigid plastics or any combinations thereof. By way of example, the rigid or semi-rigid plastic materials can include polypropylene, copolymer polypropylene, polystyrene, thermoplastic elastomers, combinations thereof, and various forms thereof. Further examples can include thermoplastic elastomers and other soft-touch resins as known in the art.

In an alternative embodiment, the container is made of a flexible non-woven or woven material. Typically, in this flexible embodiment, the container will further include a partially rigid or semi-rigid perimeter. As used herein, the term "flexible" refers to materials which are compliant and which will readily conform to the general area in which they are confined. Suitable flexible materials are described above and include, for example, meltblown, coform, air-laid, bonded-carded web materials, hydroentangled materials, and combinations and laminates thereof. In one alternative embodiment, the flexible material can include leather, suede, fabrics, synthetics that look like leather, suede, fabric, and the like.

In yet another embodiment, the container is made from at least one thin plastic flexible film material. As used herein, the term "film" refers to a thermoplastic film made using a film extrusion and/or forming process, such as a cast film oriented or blown film extrusion process. The term includes apertured films, slit films, and other porous films which constitute liquid transfer films, as well as films which do not transfer liquid. Suitable thermoplastic film materials for the container can include polyethylene, polypropylene, polystyrene, copolymer polypropylene or various other thermoformable-type materials or combinations thereof. In one particular embodiment of the dispenser, the container can include a first film, such as a polyethylene film, having a thickness of from about 0.012 millimeters (0.5 mil) to about 0.051 millimeters (2.0 mil). For example, the container film can have a thickness of about 0.032 millimeters (1.25 mil).

In one particular embodiment, the container can include multiple materials adhered together such as for a laminate. Specifically, in one embodiment, the container is a laminate material comprising a spunbond nonwoven material laminated to a moisture resistant film.

Typically, when the personal care product is a wet wipe, the laminate material for the container will include a water-impermeable material located along the surface of the internal compartment, which will keep the moisture from the wet wipes within the internal compartment and prevent leaking outside of the container. For example, a typical water-impermeable material can be manufactured from a thin plastic film or other flexible liquid-impermeable material. For example, the water-impermeable material may be formed from a polyethylene film having a thickness of from about 0.012 millimeter (0.5 mil) to about 0.051 millimeter (2.0 mils).

When it is desirable for the personal care product to maintain a relatively high degree of moisture, such as for example, wet wipes and baby wipes, the container may be made with a laminate material comprising at least one foil layer as the water-impermeable material. By way of example, in one specific embodiment, a multilayer foil pack can be produced by layering a moisture impermeable aluminum foil layer between two film layers. Specifically, the foil pack includes an external layer being a polyester or the like and having a thickness of approximately 0.48 millimeters (or 48 gauge or 0.00048 inches); a low density polyethylene film layer having a thickness of 0.75 millimeters (or 75 gauge or 0.00075 inches); an aluminum foil layer having a thickness of approximately 0.3 millimeters (or 30 gauge or 0.00030 inches); and a second linear low density polyethylene film layer having a thickness of approximately 1.25 millimeters (or 125 gauge or 0.00125 inches). The latter polyethylene film layer can act as a sealant layer to trap moisture within the personal care product.

In yet another embodiment, the container is made from a first outer film material and a second inner film material. Typically, the film material for the outer film is thicker and more resistant to tears and punctures, while the inner film material is thinner and even more flexible.

Typically, when there are two film materials, the film materials are heat or adhesively bonded to each other. Specifically, the film materials for the first outer film material and the second inner film material are selected such that they are thermobonded together to form the container. As used herein, "thermobond" or "thermobonded" refers to the process of heating the two film materials to a point at which the film materials melt and bond together.

In one embodiment, the container further includes a dispensing opening located on the outer surface of the container material and typically is disposed in the center of the container for dispensing the personal care products from the container. It should be understood by one skilled in the art that, while the dispensing opening as described herein is described as being located in the center of the container in the open position, the dispensing opening may be located in any position on the container suitable for removing (i.e., dispensing) the personal care product from the container.

In one embodiment, such as when the personal care product is a tissue product (e.g., dry product), the dispensing opening is an unsealed opening of any suitable size and shape as known in the art for dispensing the personal care product. It is desirable that the unsealed opening not be too large to prevent overexposing the personal care product to air. This will also improve moisture retention of the personal care product when the product is a wet wipe. Furthermore, this configuration will prevent the personal care product from accidentally falling out of the container and becoming contaminated. As such, in one particularly preferred embodiment, the dispensing opening is circular and has a total opening area of about 50% of the surface of the unfolded personal care product. More suitably, the dispensing opening has a total opening area of from about 2% to about 25% of the surface area of the unfolded personal care product; and even more suitably, from about 10% to about 20% of the surface area of the unfolded personal care product. While the dispensing opening discussed in the embodiment above is circular, it should be understood by one skilled in the art that the dispensing opening can be any other suitable shape known in the art such as oval, rectangular, square, linear slit, and the like, without departing from the scope of the present disclosure.

In another embodiment, when the personal care product contains moisture, such as a wet wipe, the dispensing opening can be sealed. Particularly, in one embodiment, a semi-rigid plastic seal can releasably seal the dispensing opening. Typically, the semi-rigid plastic seal is made from polypropylene, copolymer polypropylene, polystyrene, thermoplastic elastomers, combinations thereof, and various forms thereof. Further examples can include thermoplastic elastomers and other soft-touch resins as known in the art. Specifically, the plastic seal is attached to at least one of the external edges of the container or the internal face, and completely or partially covers or surrounds the dispensing opening. The seal can then be opened to reveal the dispensing opening and allow for removal of the personal care product from the container.

Typically, the semi-rigid plastic seal can be adhesively secured to the container by any adhesive composition known in the art. Particularly, preferred adhesive compositions include hot-melt adhesive compositions such as disclosed in U.S. Pat. Nos. 6,774,069, 6,872,784, and RE39,307, all issued to Zhou et al. and the disclosures of which are hereby incorporated by reference to the extent they are consistent herewith.

In another embodiment, the dispensing opening can be sealed using a resealable film seal. Specifically, when the layer of the film material used in the resealable film seal is pulled away from the outer surface of the container, the dispensing opening is revealed, through which a personal care product can be dispensed. The resealable film seal can be attached to the outer surface of the container using any means known in the art. For example, referring to FIG. 13*a*, the resealable film seal 180 over the dispensing opening 190 can be re-sealed using an adhesive composition (see FIG. 13*a*). Adhesive compositions for use in these types of adhesive resealable film seals are well known in the art and any of these compositions can be used to seal the dispensing opening of the container in this embodiment.

Moreover, in one particularly preferred embodiment, the resealable film seal 180 may adapt to further act as a label for the personal care product stored in the container 100. For example, in one embodiment, the resealable film seal is a 1.0 millimeter (0.001 inch) thick oriented polypropylene (OPP) label with a removable acrylic adhesive, such as Fasson® R143.

Typically, when a resealable film seal and/or label is used, the resealable film seal will include a crease or fold within the seal material to allow the container to fold into a closed position. Further, the container will typically be held in the closed position using a separate latching mechanism such as an adhesive or Velcro, as described more fully herein.

Other suitable film materials for use in the resealable film seal include paper laminates, plastic laminates, polyester, and the like.

In yet another embodiment, the dispensing opening can be sealed using a rigid or semi-rigid plastic closing device. For example, in one embodiment, the plastic closing device includes a male/female latching system such as described for closing the container herein. Specifically, the male and female latching system would be attached around the dispensing opening such as by using an adhesive composition. The male and female sections would be connected, but would form a hinge at the folding point of the container. Then when the container was closed, the male and female sections would then snap or hook to each other, thereby sealing the dispensing opening.

Suitable rigid or semi-rigid plastic closing devices can include materials such as polyolefins, styrenics, or other semi-rigid plastics or any combinations thereof. By way of example, the rigid or semi-rigid plastic materials can include polypropylene, copolymer polypropylene, polystyrene, and various forms thereof. Further examples can include thermoplastic elastomers and other soft-touch resins as known in the art.

In addition to the dispensing opening for dispensing the personal care product from the container, the container may further include a refilling opening to provide a larger opening for refilling the personal care products in the container. Specifically, by having the refilling opening, the user does not have to manipulate the personal care product (e.g., fold or bunch up the product) from its full, flat orientation prior to refilling the container. This allows the container to be more easily and efficiently refilled with personal care products for later dispensing.

For example, in one embodiment, the refilling opening is covered by a lid that can flip open from the external rim of the container, as described more fully herein, to allow for the user to refill the container with personal care products. Additional suitable refilling openings are described more fully with reference to the figures herein below. In another embodiment, the refilling opening can be sealed using a zip slider resealable seal such as the type commonly used on Ziplock® bags. Specifically, the zip slider resealable seal surrounds the internal compartment or other refilling opening within the container and zips open and closed for sealing and resealing the refilling opening.

Typically, as noted above, the container has an internal compartment that holds the personal care products in a full, flat orientation when in an open position. The personal care products can be removed, preferably in a single consistent manner, from the internal compartment of the container when the container is in the open position.

Typical sizes for the container in the open position will depend upon the desired personal care product for which the container is to store. For example, in one embodiment, the container is designed to store baby wet wipes, which typically have a surface area when in a full, flat orientation of approximately 26.3 $in^2$. As such, the container, when in an open position for both refilling and removing the wipes into the internal compartment of the container, has a surface area of from approximately 26 $in^2$ to approximately 45 $in^2$.

Once the internal compartment is filled with the personal care product such as a wet wipe or, once the wet wipe has been removed from the internal compartment, the container is then folded and closed. When in the closed position, the container is specifically configured so as to have an equal or smaller surface area in the closed position as compared to the surface area of the full, flat personal care product. Suitably, the container has a surface area when in the closed position of no greater than about 100% of the surface area of the personal care product in its full, flat orientation. More suitably, the container has a surface area when in the closed position of no greater than about 90% of the surface area of the personal care product in its full, flat orientation. Even more suitably, the container has a surface area when in the closed position of no greater than about 80% of the surface area of the personal care product in its full, flat orientation, even more suitably, no greater than about 70%, even more suitably, no greater than about 65% of the surface area of the personal care product in its full, flat orientation and, even more suitably, no greater than about 60% of the surface area of the personal care product in its full, flat orientation.

Figure 1B:
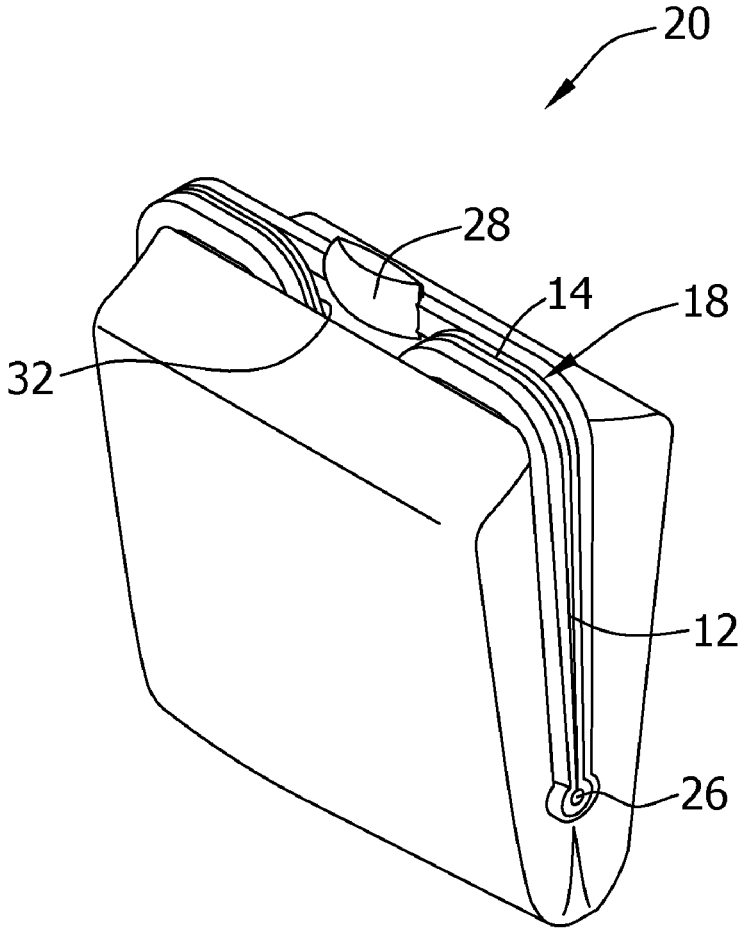
FIG. 1*b* is a view of the dispenser in FIG. 1*a* in a closed (i.e., folded) position.

With reference now to FIGS. 1*a* and 1*b*, in one embodiment, the container 20 includes an internal compartment 22 for holding the personal care product 100; a first hinge 24 disposed on a first external lateral edge 10 surrounding the internal compartment 22 of the container 20 and a second hinge 26 disposed on a second opposing external lateral edge 12 surrounding the internal compartment 22 of the container 20, and a latching device 28 located on at least one longitudinal edge 14 surrounding the internal compartment 22 of the container. The first hinge 24 and second hinge 26 are together configured for folding the container 20 from an opened position (FIG. 1*a*) into a closed position (FIG. 1*b*). As seen in FIG. 1*b*, the latching device 28 is configured for holding the container 20 in the closed position. While the latching device 28 of FIG. 1 is shown to be located on at least one longitudinal edge 14 surrounding the internal compartment 22 of the container, it should be understood by one skilled in the art that the latching device may be located on any external or internal side of the container that is capable of keeping the product within the container without departing from the scope of the present disclosure.

Figure 11A:
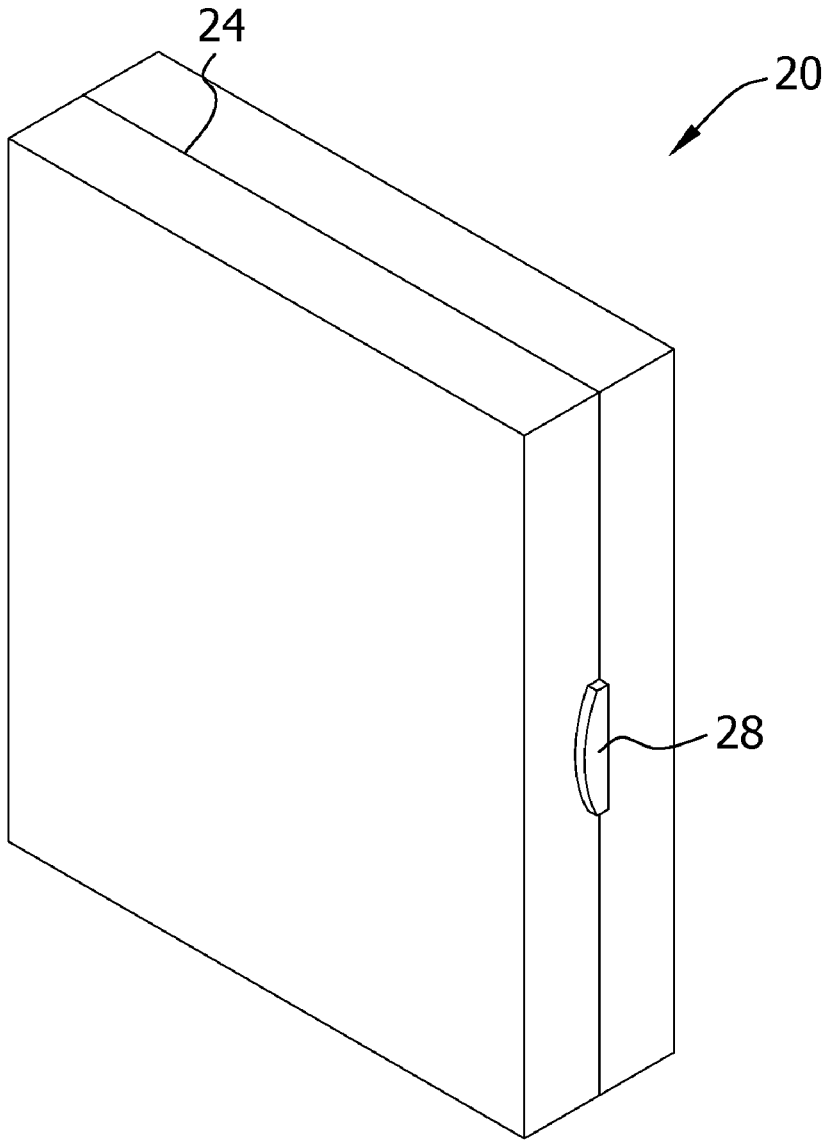
FIG. 11*a* is a view of an eleventh representative embodiment of a dispenser of the present disclosure.
Figure 11B:
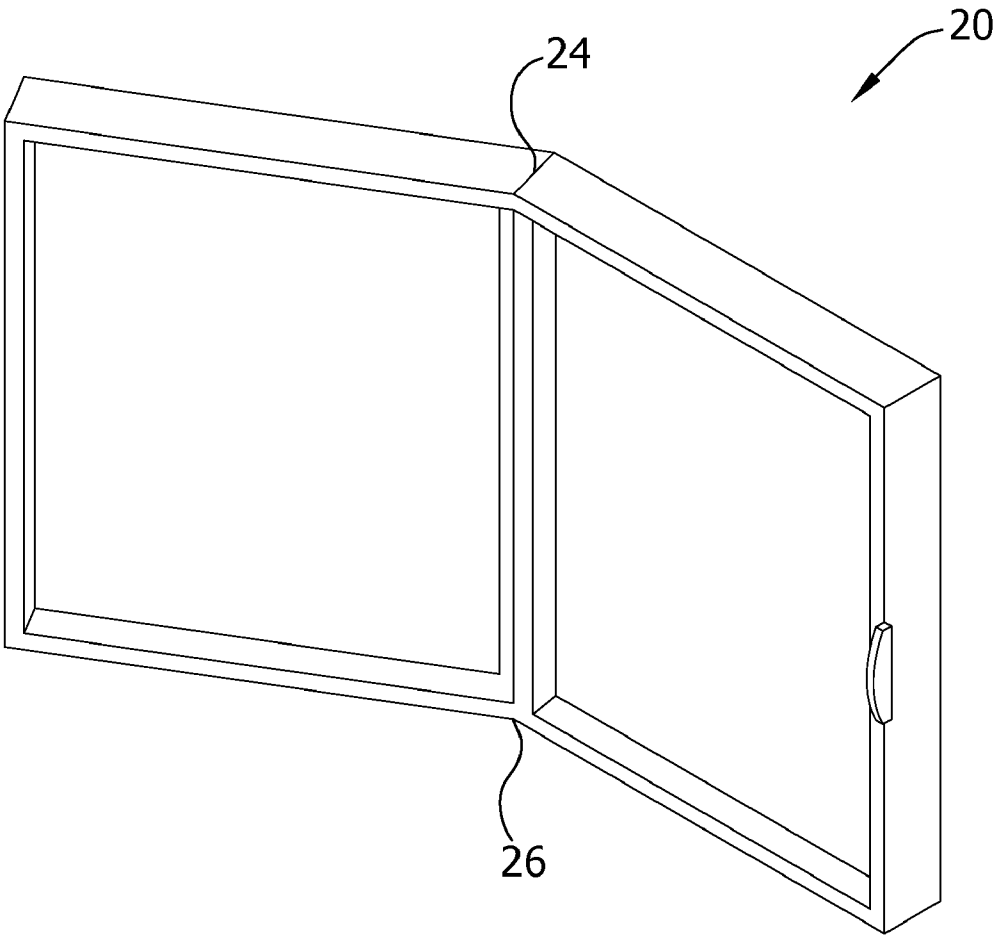
FIG. 11*b* is a view of the dispenser in FIG. 11*a* in the open (i.e., unfolded) position.
Figure 12:
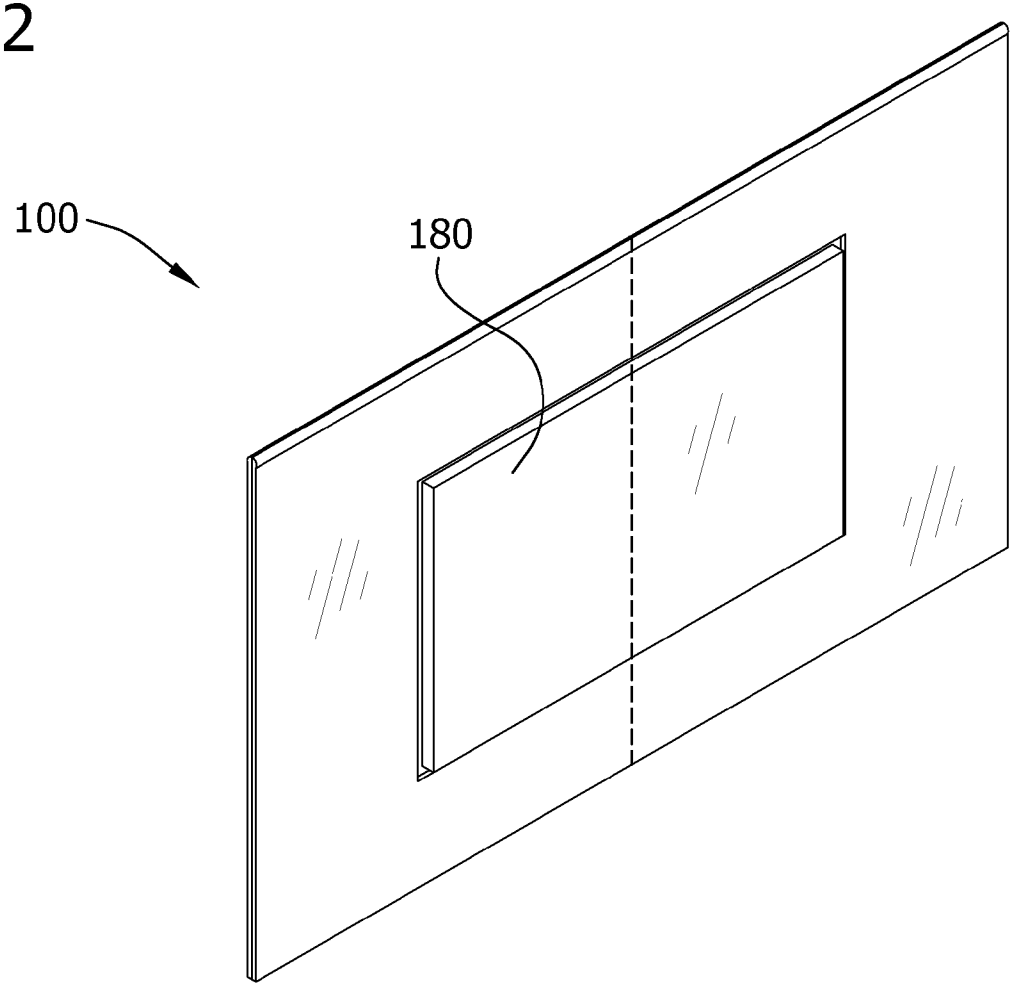
FIG. 12 is a view of a twelfth representative embodiment of a dispenser of the present disclosure.

By way of further example, as shown in FIGS. 11*a* and 11*b*, the open container (FIG. 11*b*) has the first hinge 24 and the second hinge 26 for folding the container 20. The container 20 can then be latched using the latching device 28 to hold the container 20 in the closed position (FIG. 11*a*).

The first hinge 24 and second hinge 26 are living hinges comprised of any material suitable in the art. For example, the hinges can be cut-out notches within the edge of the container (as shown in FIGS. 1*a* and 1*b*), creases or folds within the edges of the container, pivot points within the edge of the container, knuckles, separate hinge pieces, formed hinges using one or more pins that fit into one or more holes, flexible straps, adhesive tape seams, or any other hinge or pivoting device as known in the art.

The latching device 28 may be any latching device for holding a container in a closed position as known in the art. One particularly preferred latching device is a male/female latching device as shown in FIGS. 1*a* and 1*b*. Specifically, to close the container, the male portion, indicated at 30, is snapped into the female portion, generally indicated at 32.

Another preferred latching device is an adhesive resealable seal, similar to the resealable film material described above for sealing the dispensing opening. In this latter embodiment, an adhesive composition is applied to the external lateral and/or longitudinal edges surrounding the internal compartment of the container and is capable of sealing the external edges when the container is in a closed position. The external edges can be pulled apart by the user to open the container and, once the personal care product is removed from the container, the external edges can be resealed using the adhesive composition. Any resealable adhesive composition as know in the art can suitable be used as the adhesive composition for holding the container in a closed position. As noted above, while the latching device (e.g., adhesive resealable seal) of the above-described embodiment is located on the external edge of the container, it should be recognized by one skilled in the art that the latching device can be located internally on an internal edge of the container without departing from the scope of the present disclosure.

Figure 13A:
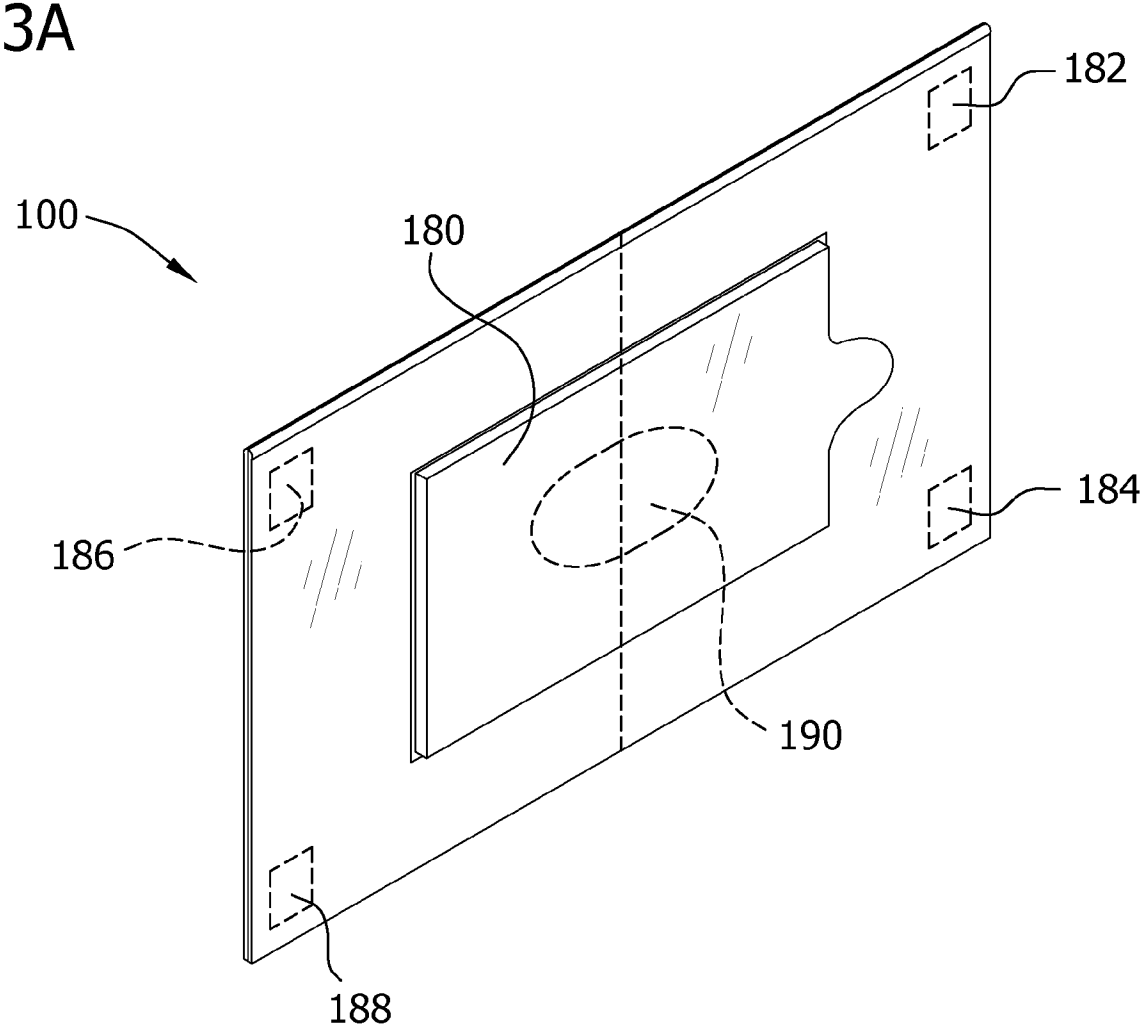
FIG. 13*a* is a view of a thirteenth representative embodiment of a dispenser of the present disclosure.
Figure 13B:
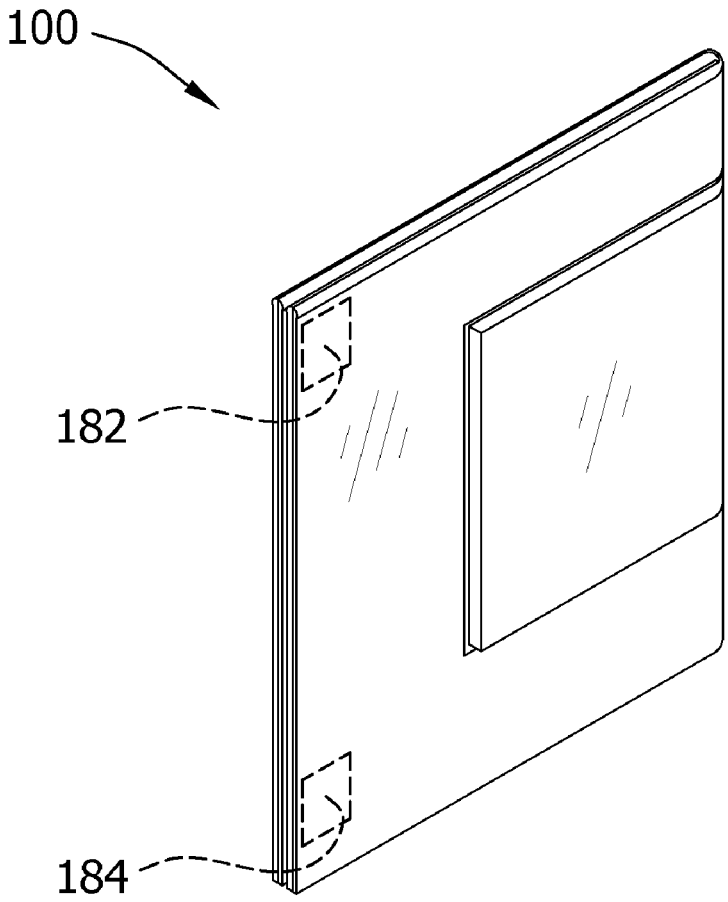
FIG. 13*b* is a view of the dispenser in FIG. 13*a* in the closed (i.e., folded) position.

Other suitable latching devices for use in holding the container in a closed position can include snaps, straps, hook and loop (for example, Velcro®), zip sliders such as the type commonly used on Ziplock® bags, and the like. Specifically, in one embodiment, such as shown in FIGS. 13*a* and 13*b*, the container is held in a closed position using hook and loop patches 182, 184, 186, and 188 (FIG. 13*a*). Specifically, hook and loop patch 182 attaches to hook and loop patch 186 and hook loop patch 184 attaches to hook and loop patch 188, thereby latching the container and holding the container in the closed position, as shown in FIG. 13*b*.

Generally, the latching device can be located on at least one external or internal edge of the container. For example, in one embodiment, as depicted in FIGS. 1*a* and 1*b*, the latching device 28 is located on the external longitudinal edge 14 of the container 20. In an alternative embodiment, however, the latching device 182, 184, 186, and 188 is multiple Velcro tabs that are located on internal longitudinal edges of the container 100.

Referring back to FIG. 1, in one embodiment, the container 20 further comprises a rigid external rim, generally indicated at 18, which surrounds the internal compartment 22 of the container 20. In this embodiment, the first hinge 24 and second hinge 26 are cut-out notches in the external rim 18 surrounding the internal compartment 22 of the container 20. Furthermore, the latching device 28 is disposed on the two opposing external longitudinal edges 14 and 16 of the external rim 18.

Furthermore, the container 20 of FIG. 1 further includes two clips 40 and 42 disposed in such a position as to hold the personal care product within the internal compartment 22 of the container 20. While shown in FIG. 1 as thin elastic bands, it should be understood by one skilled in the art that the clip(s) can be in a variety of other shapes and/or sizes such as a wide door-type cover (see FIGS. 4*a*, 4*b*, 5, 6*a*, 6*b*, 8*a*, 9, and 10*a*) or a plastic cover (see FIGS. 7*a* and 7*b*).

Specifically, the clips 40 and 42 of FIG. 1 are disposed longitudinally over the internal compartment 22, thereby connecting the first lateral edge 10 to the second lateral edge 12. While the embodiment as shown in FIG. 1 indicates two clips within the container, it should be recognized by one having skill in the art that the container may only have one clip or may not even include a clip for holding the personal care product within the internal compartment of the container. Alternatively, it should be recognized that more than two clips can also be used for the holding the personal care product within the internal compartment.

Suitably, the clips can be made of any suitable material known in the art for holding the personal care product within the internal compartment. In one particularly preferred embodiment, the clips are made of an elastic material, such as elastic bands. Specifically, suitable elastic materials can include, for example, natural rubber or rubber derived materials.

In another embodiment, the clips are made from a plastic material. One particularly preferred plastic material is a thermoplastic elastomer. As used herein, "thermoplastic elastomer" or "elastomeric" refer to polymeric materials that have properties of stretchability and recovery, such as the rubber-type thermoplastic elastomers described in U.S. Pat. No. 6,766,919, issued to Huang, et al. (Jul. 27, 2004), which is hereby incorporated by reference to the extent it is consistent herewith.

In FIG. 1, the first clip 40 and second clip 42 are disposed parallel from each other in the lateral direction. Furthermore, in FIG. 1, the first clip 40 is disposed within a first lateral half 50 of the internal compartment of the container 20 and the second clip 42 is disposed within a second lateral half 52 of the internal compartment of the container 20 when the container 20 is in the open position. In this embodiment, the first clip 40 and second clip 42 are attached to the lateral edges 10, 12 of the container 20.

It should be recognized that the first clip and second clip, however, could be disposed in any other suitable direction and configuration for holding the personal care product within the internal compartment of the container. For example, now referring to FIG. 2, in another embodiment, the first clip 140 is in direct contact with the second clip 142, thereby forming a cross bar 150 within the internal compartment 122 of the container 120. Suitably, as shown in FIG. 2, the cross bar 150 includes a hinge 125 running through the center of the cross bar 150 that allows the container 120 to fold into a closed position.

Figure 2:
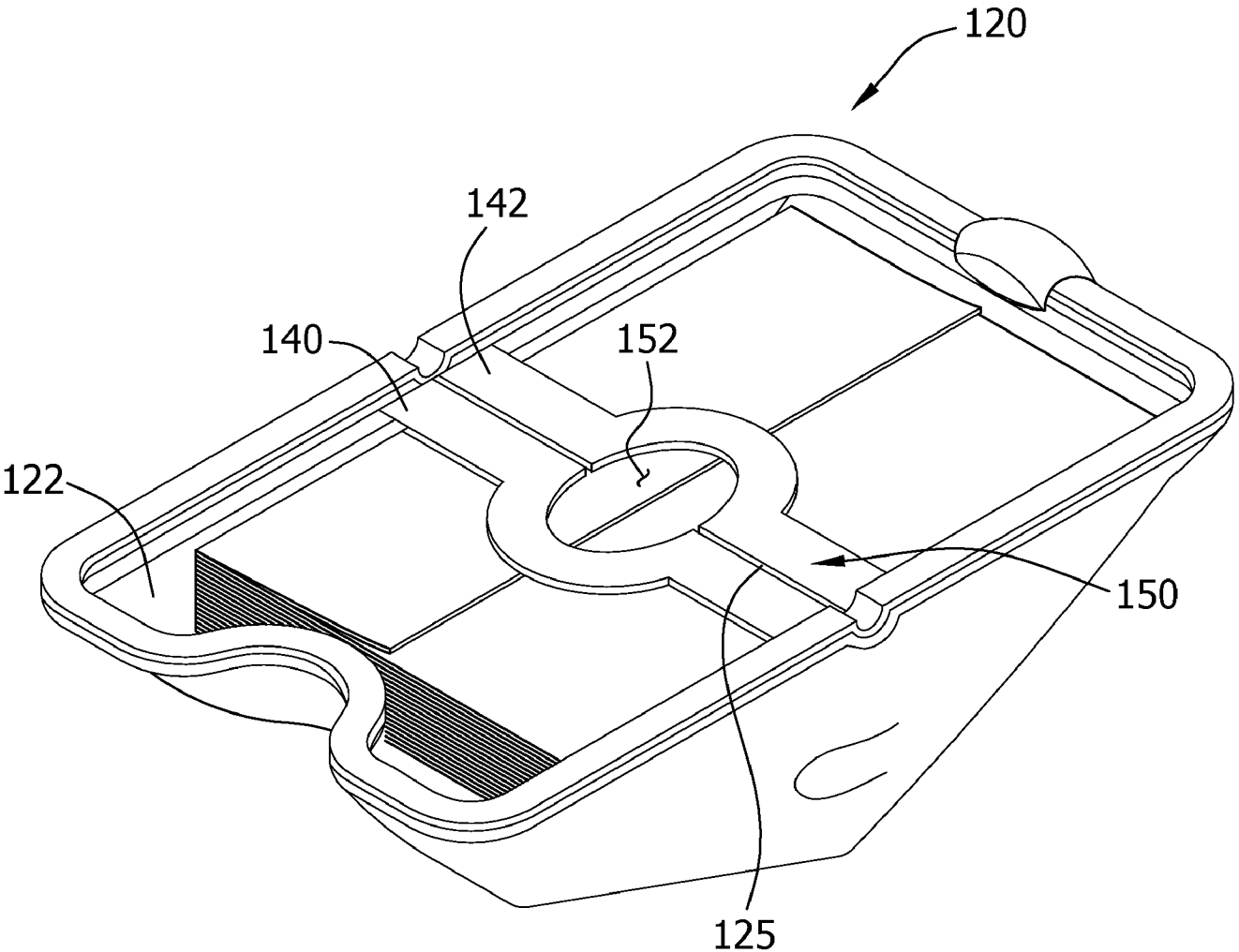
FIG. 2 is a view of a second representative embodiment of a dispenser of the present disclosure.

Still referring to FIG. 2, in one embodiment, the cross bar 150 can further include a dispensing opening 152 within the center of the cross bar to allow for easy removal of the personal care product from the internal compartment 122 of the container 120. Specifically, by including the dispensing opening 152, a user can open the container 120 into an open position and simply pull the personal care product through the dispensing opening 152 to remove the personal care product. In one preferable embodiment, the dispensing opening is a circular dispensing opening. It should be recognized, however, that the opening may be any suitable shape for removing (i.e., dispensing) the personal care product from the internal compartment as known in the art.

Figure 3A:
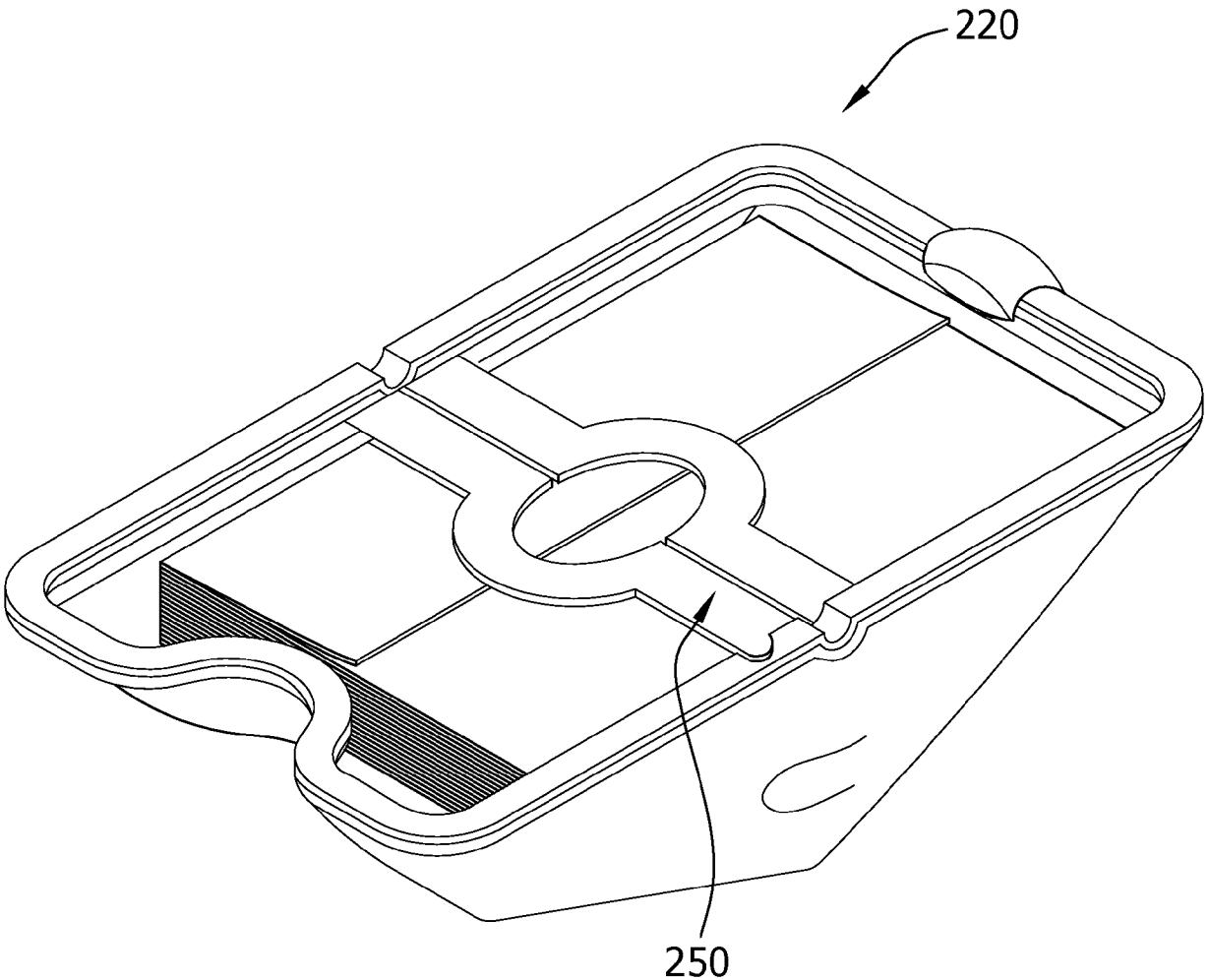
FIG. 3*a* is a view of a third representative embodiment of a dispenser of the present disclosure.
Figure 3B:
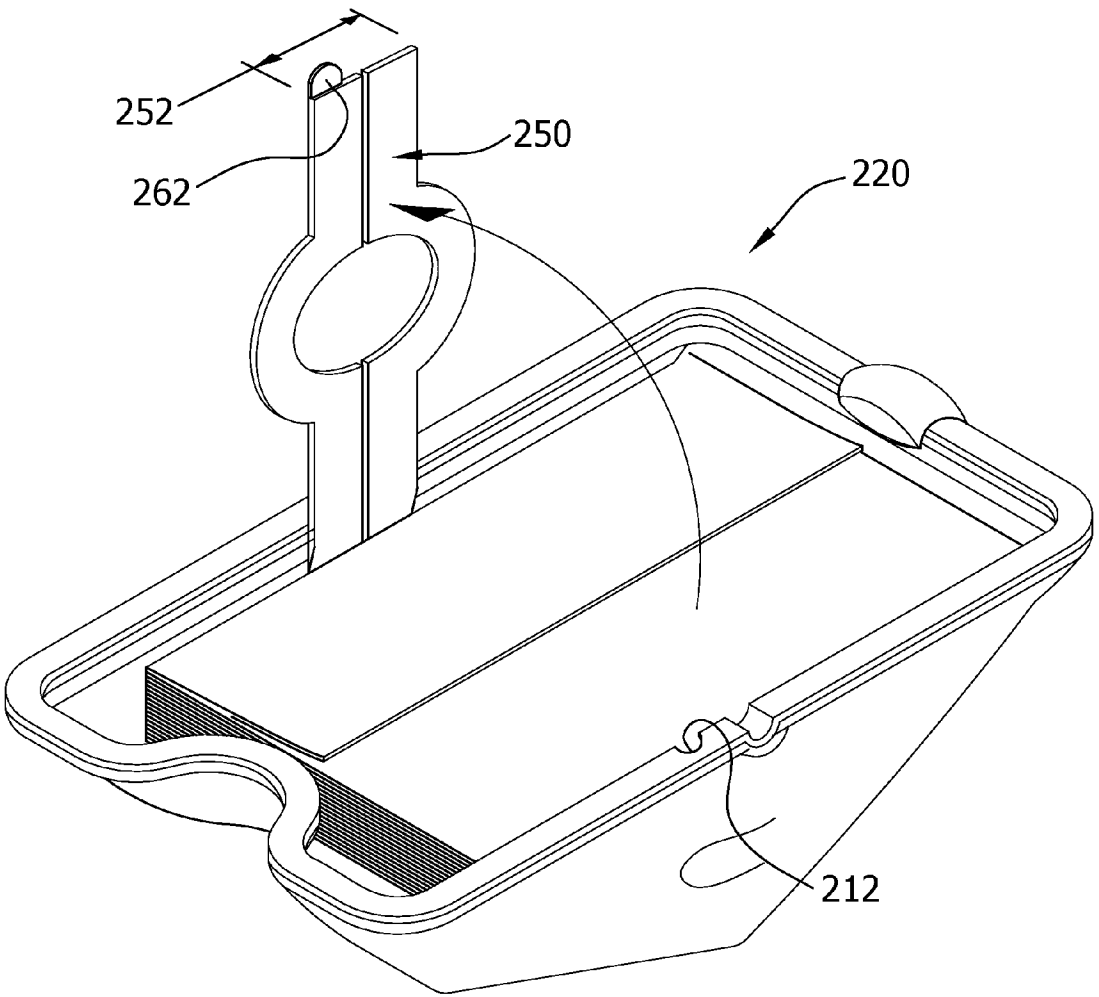
FIG. 3*b* is a view of the third representative embodiment of the dispenser of the present disclosure as shown in FIG. 3*a* in which the internal compartment of the dispenser has been entirely exposed.

Furthermore, now referring to FIG. 3*b*, the cross bar 250 can further include a fastening component 262 disposed on one lateral end 252 of the cross bar 250 for fastening the cross bar 250 to one external lateral edge 212 of the container 220. Typically, the fastening component is capable of releasably fastening the cross bar to the external lateral edge of the container. By including the fastening component, the cross bar can be flipped up and away from the internal compartment of the container to allow for easy filling and/or removing of one or more personal care products to/from the internal compartment of the container. While FIG. 3 depicts one fastening component 262 located at one lateral end 252 of the cross bar 250 for flipping the cross bar 250 away from the internal compartment of the container, it should be recognized that either lateral end or even both lateral ends of the cross bar may have a fastening component for releasably fastening the cross bar to the external lateral edge of the container.

While described herein as being attached to either each other or to the lateral edges of the container, it should be understood by one skilled in the art that the clips can be attached to a third component of the container, such as the longitudinal edges, or another device or mechanism located within or on the container and still be within the scope of this disclosure.

Figure 4A:
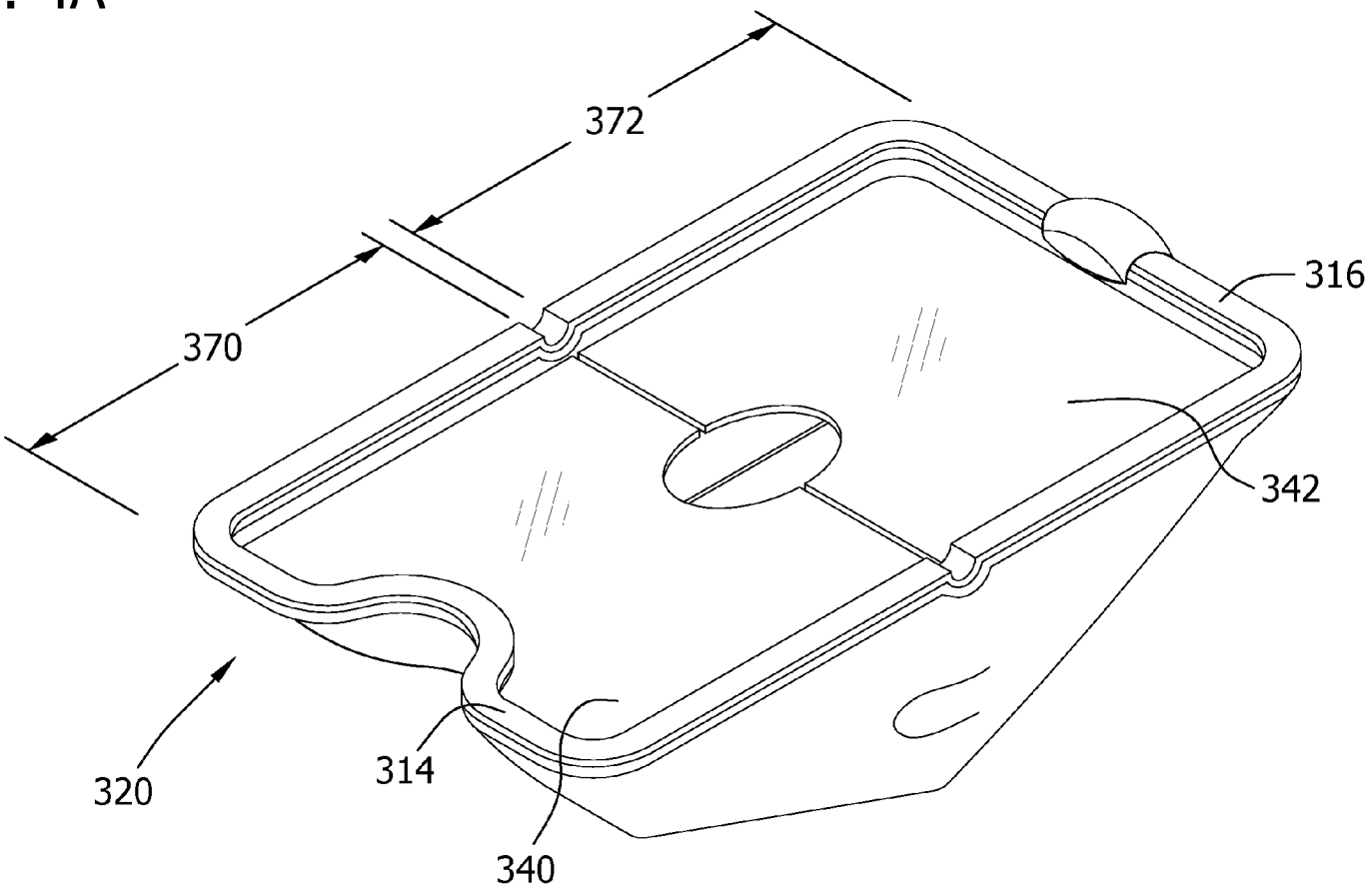
FIG. 4*a* is a view of a fourth representative embodiment of a dispenser of the present disclosure.
Figure 4B:
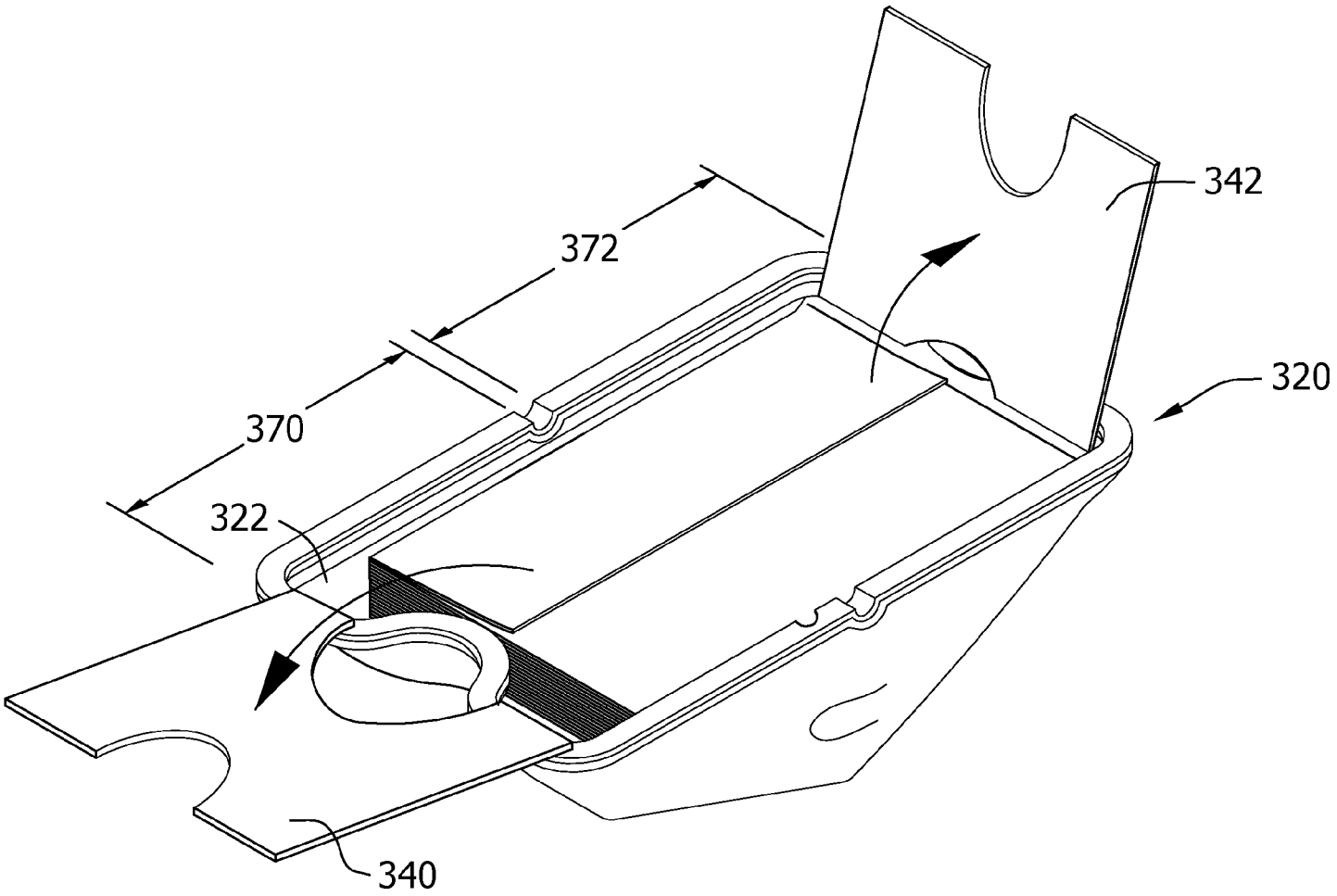
FIG. 4*b* is a view of the fourth representative embodiment of the dispenser of the present disclosure as shown in FIG. 4*a* in which the internal compartment of the dispenser has been entirely exposed.

In yet another embodiment, as shown in FIGS. 4*a* and 4*b*, the first clip 340 is configured to substantially enclose the first lateral half of the container, generally indicated at 370, when disposed flat over the internal compartment 322 of the container 320. The second clip 342 is configured to substantially enclose the second lateral half of the container, generally indicated at 372, when disposed flat over the internal compartment 322 of the container 320. As such, when both the first clip 340 and the second clip 342 are disposed flat over the internal compartment 322 of the container 320, substantially all of the internal compartment 322 of the container 320 is enclosed (see FIG. 4*a*).

Additionally, the first clip 340 and the second clip 342 can independently be attached to a first external longitudinal edge 314 and a second opposing external longitudinal edge 316 using a hinge (not shown) such as described for the container in FIGS. 1*a* and 1*b* above. As such, the first clip 340 and second clip 342 can pivot via the hinges to flip the first clip 340 and second clip 342 respectfully up and away from the internal compartment 322 of the container 320, thereby exposing the personal care product to the user (see FIG. 4*b*) to allow the user to refill or remove the product. While FIGS. 4*a* and 4*b* depict that both the first clip and the second clip can be flipped open via their respective hinges, it should be understood that only one of the clips may have a hinge and, thus, only one half of the internal compartment may be opened for exposing the personal care product.

Figure 5:
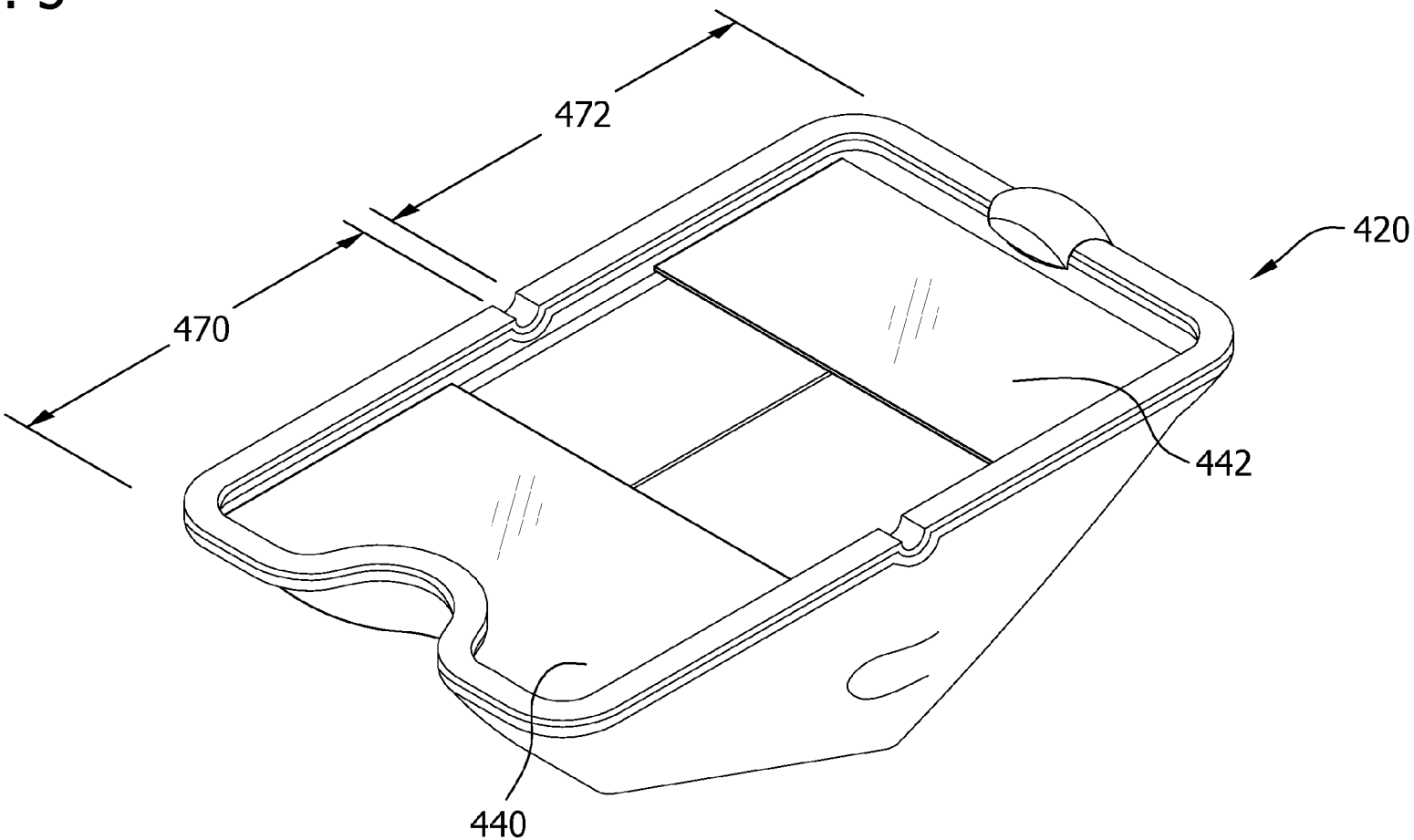
FIG. 5 is a view of a fifth representative embodiment of a dispenser of the present disclosure.

In an alternative embodiment, as shown in FIG. 5, the first clip 440 and second clip 442 partially close the first lateral half 470 and second lateral half 472 respectfully of the internal compartment when disposed flat over the internal compartment of the container 420. In this embodiment, the first clip and second clip can be attached with a first and second hinge as described in FIGS. 4*a* and 4*b* above, or can be in permanent contact with the first longitudinal edge and second longitudinal edge (as shown in FIG. 5). In the latter embodiment, the first clip 440 and second clip 442 are sized so that the personal care product within the internal compartment can be easily removed without removing the first and/or second clip.

Figure 6A:
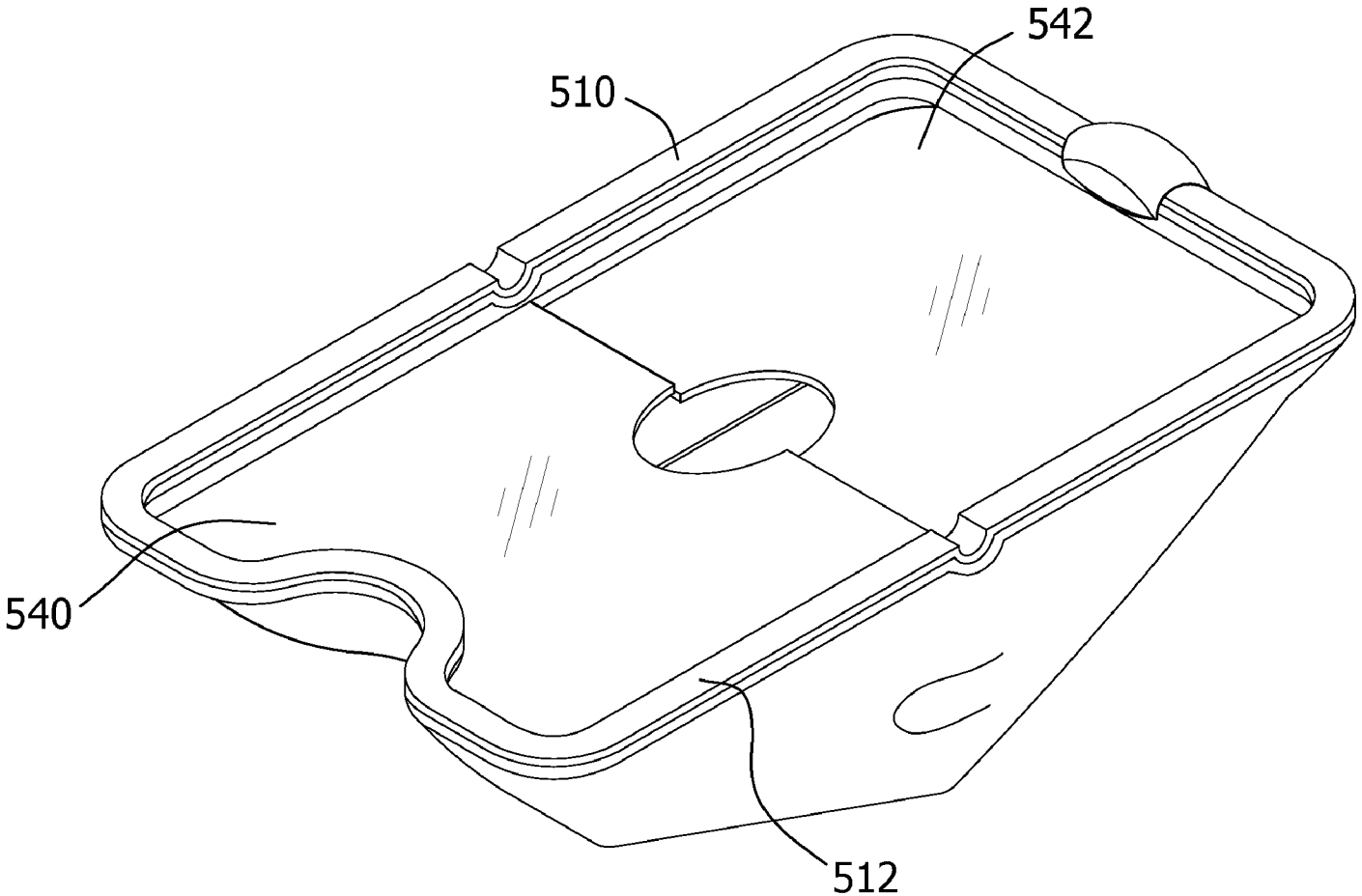
FIG. 6*a* is a view of a sixth representative embodiment of a dispenser of the present disclosure.
Figure 6B:
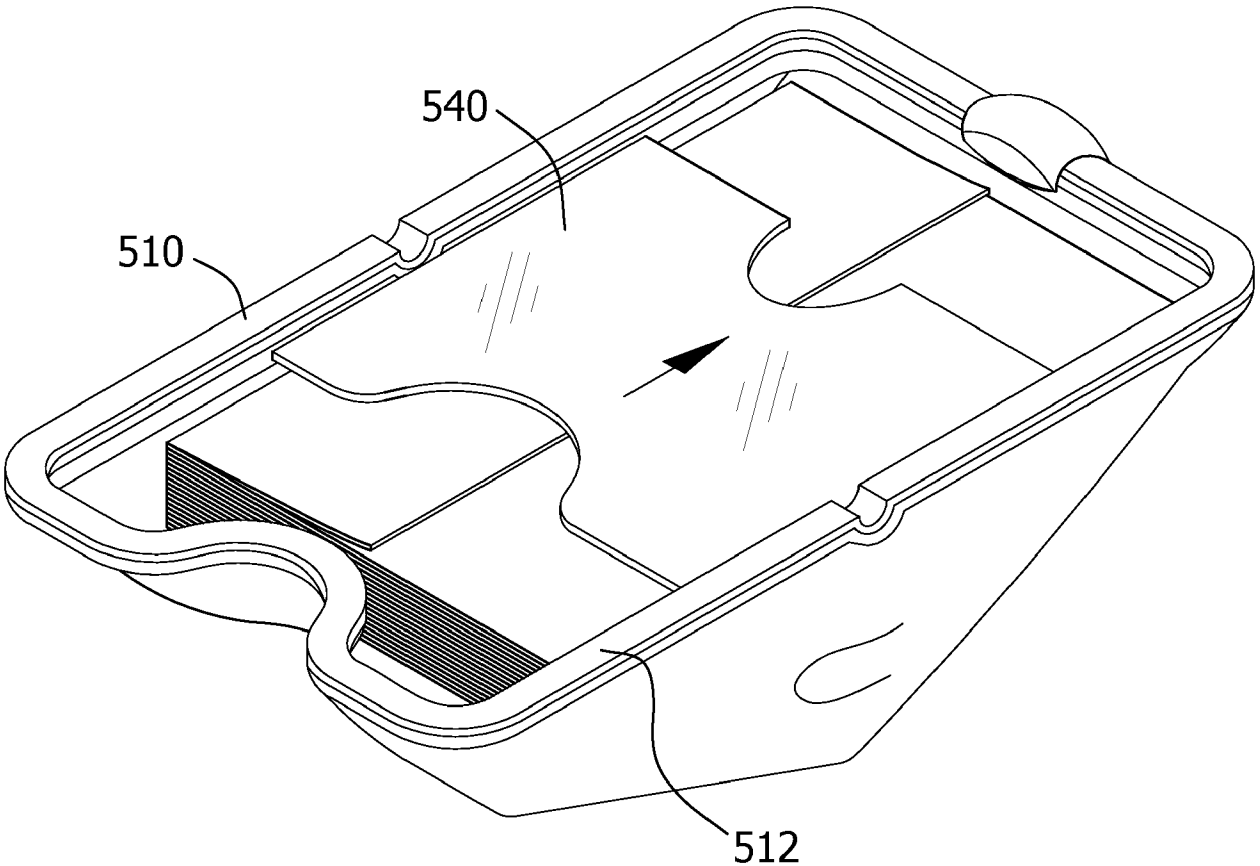
FIG. 6*b* is a view of the sixth representative embodiment of the dispenser of the present disclosure as shown in FIG. 6*a* in which the internal compartment of the dispenser has been partially exposed.

In yet another alternative embodiment, as shown in FIGS. 6*a* and 6*b*, the first clip 540 and second clip 542 (shown in 6*a*) are attached to the lateral edges 510 and 512 in such a manner as to allow the first clip 540 and second clip 542 to slide laterally over the internal compartment of the container to expose the personal care product (see FIG. 6*b*). Again, while FIG. 6*b* shows that both the first clip 540 and second clip 542 are configured to slide, it should be understood that only one of the clips may be configured to slide and, thus, only one half of the internal compartment may be opened to expose the personal care product.

Figure 7A:
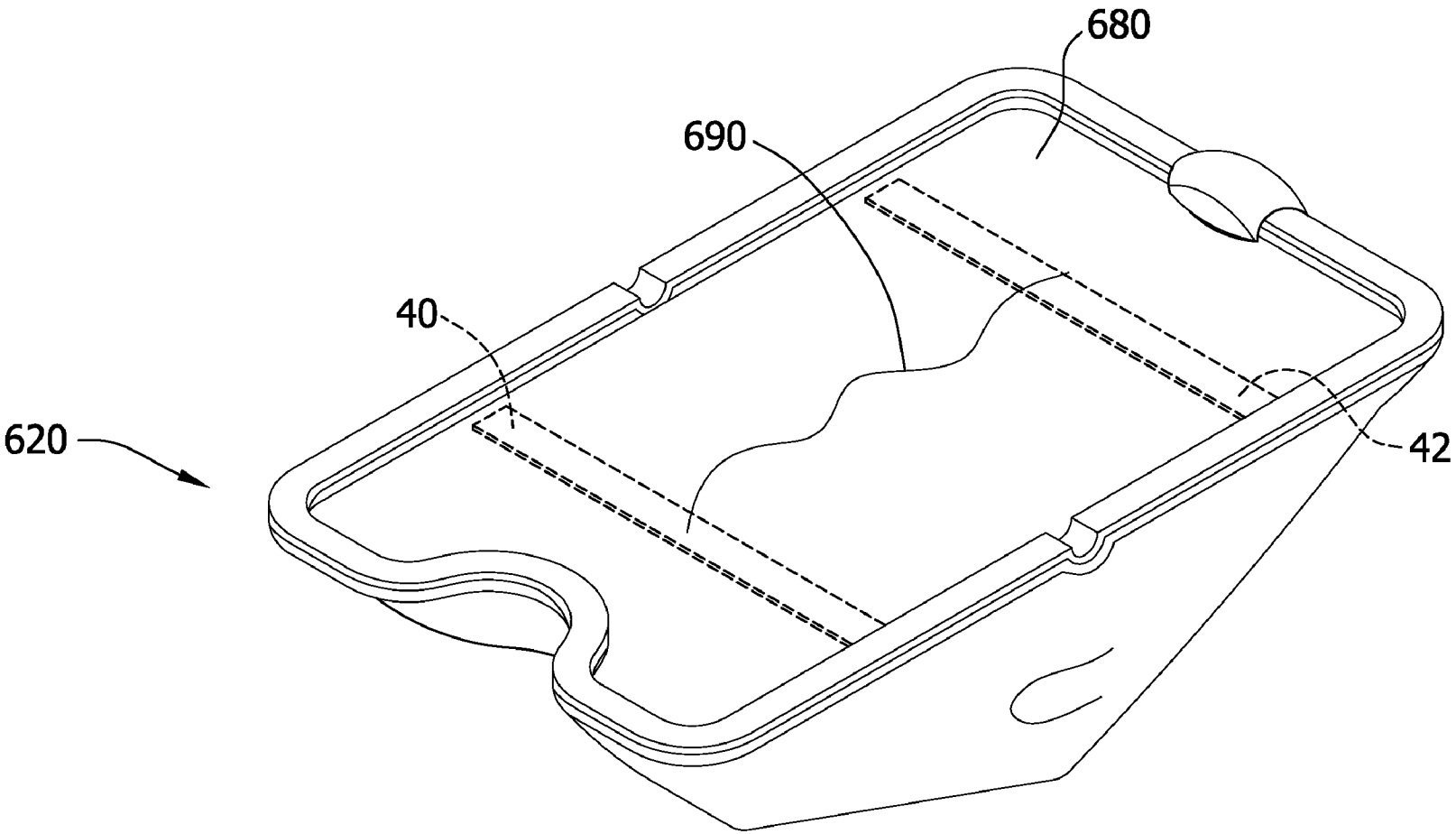
FIG. 7*a* is a view of a seventh representative embodiment of a dispenser of the present disclosure.
Figure 7B:
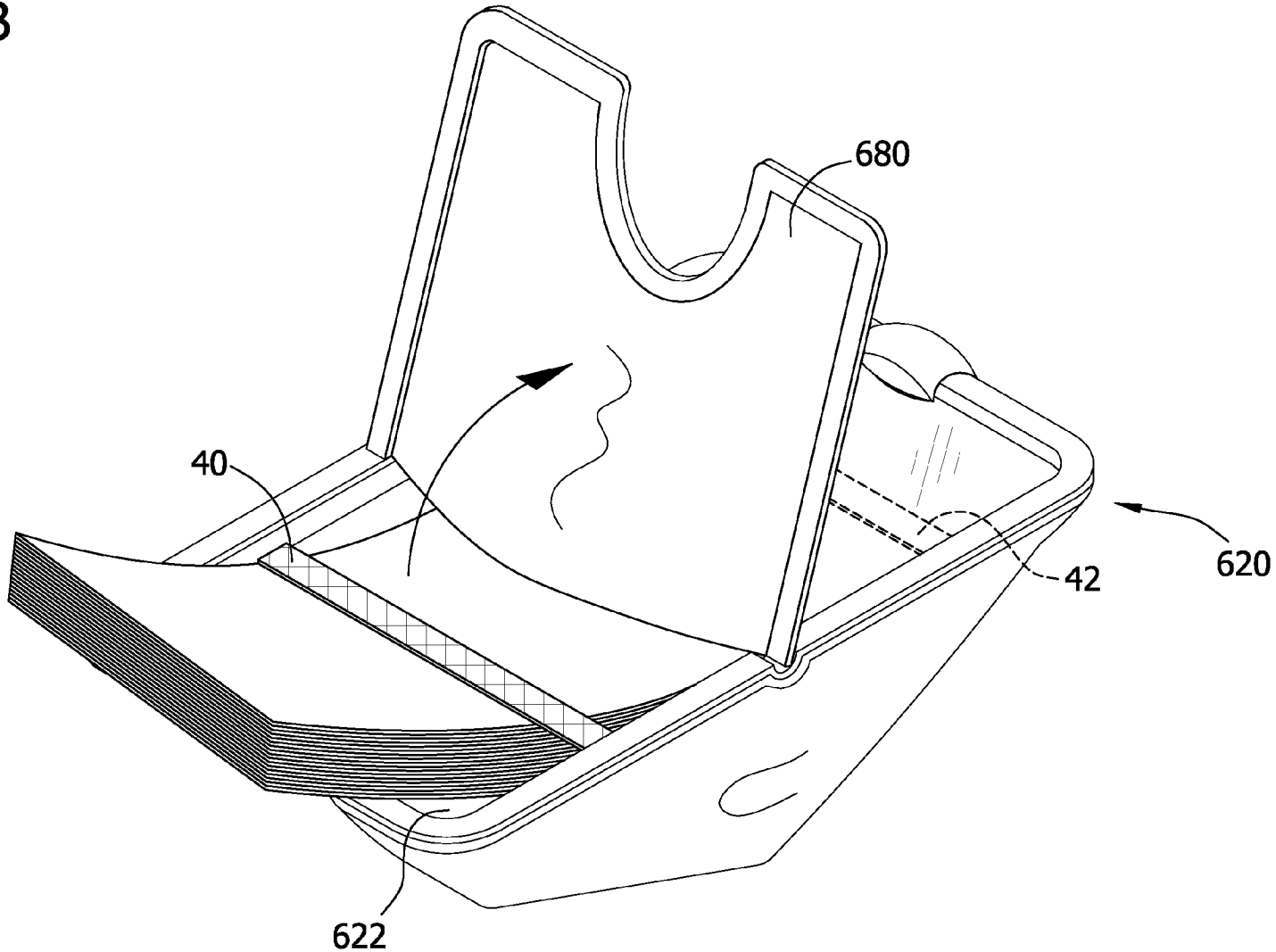
FIG. 7*b* is a view of the seventh representative embodiment of the dispenser of the present disclosure as shown in FIG. 7*a* in which the internal compartment of the dispenser has been partially exposed.
Figure 8A:
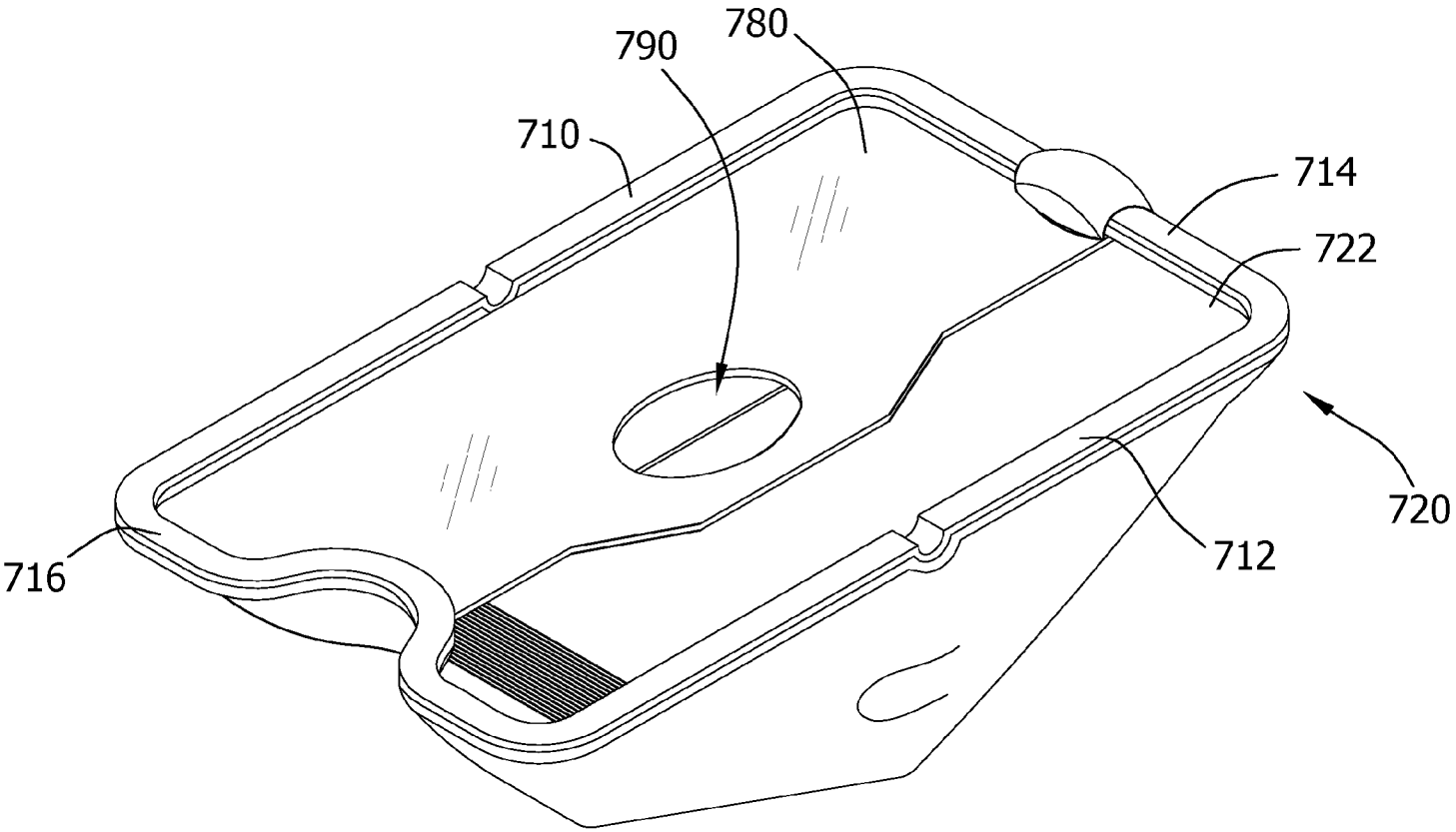
FIG. 8*a* is a view of an eighth representative embodiment of a dispenser of the present disclosure.
Figure 8B:
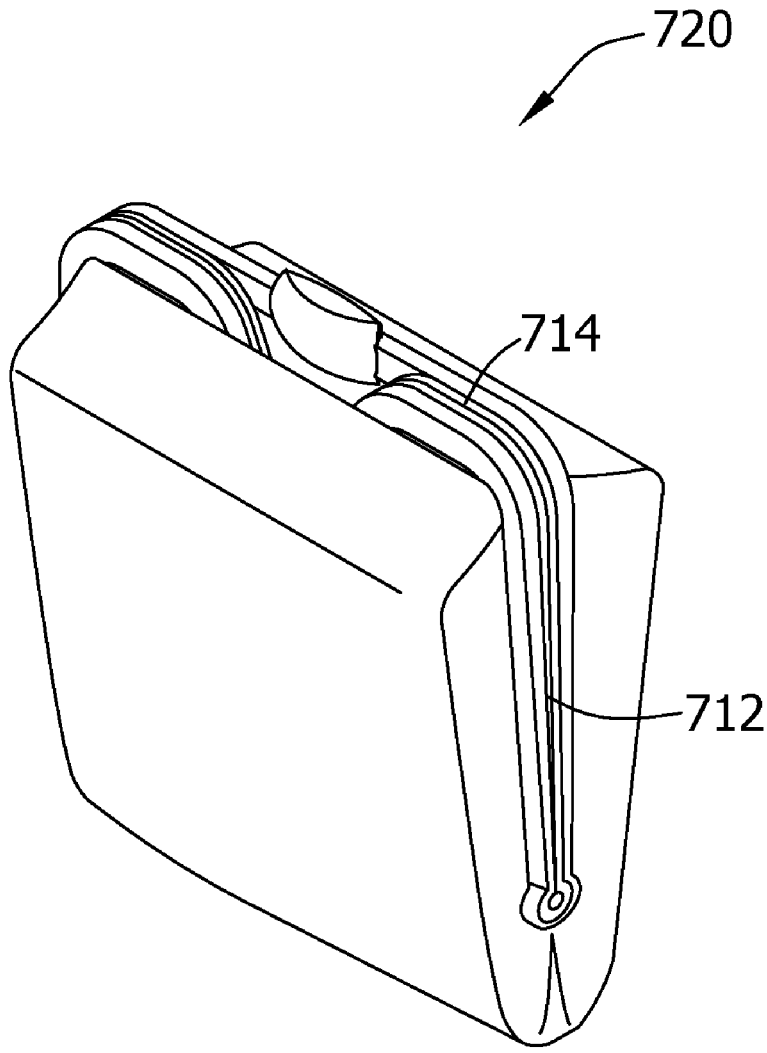
FIG. 8*b* is a view of the dispenser in FIG. 8*a* in a closed (i.e., folded) position.

In one embodiment, the container can further include a lid. As described more fully above, in many embodiments, the lid is opened to reveal a refilling opening to allow for easy refill of the personal care product without substantive folding or manipulation of the personal care product by the user. For example, as shown in FIGS. 7*a* and 7*b*, the lid 680 fully encloses the internal compartment 622 of the container 620 when in the down position (see FIG. 7*a*). While shown to fully enclose the internal compartment in FIGS. 7*a* and 7*b*, it should be recognized by one skilled in the art that the lid may be configured to only partially enclose the internal compartment of the container. For example, as shown in FIGS. 8*a* and 8*b*, the lid 780 encloses three-quarters of the internal compartment 722 of the container 720 and is in direct contact with a first longitudinal edge 714, a second opposing longitudinal edge 716, and a first lateral edge 710.

Figure 9:
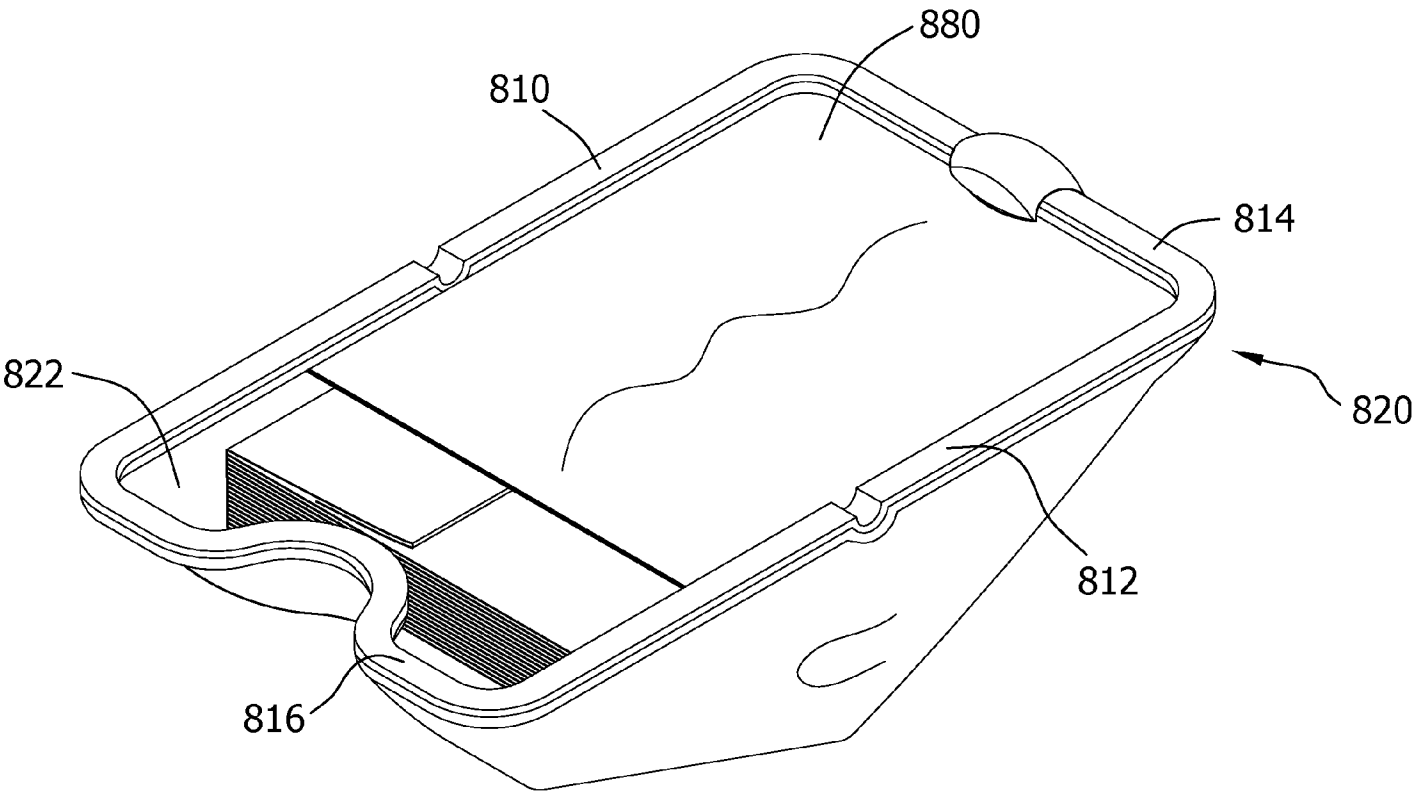
FIG. 9 is a view of a ninth representative embodiment of a dispenser of the present disclosure.

In another embodiment, as shown in FIG. 9, the lid 880 encloses three-quarters of the internal compartment 822 of the container 820 and is in direct contact with a first lateral edge 810, a second opposing lateral edge 812, and a first longitudinal edge 814.

Figure 10A:
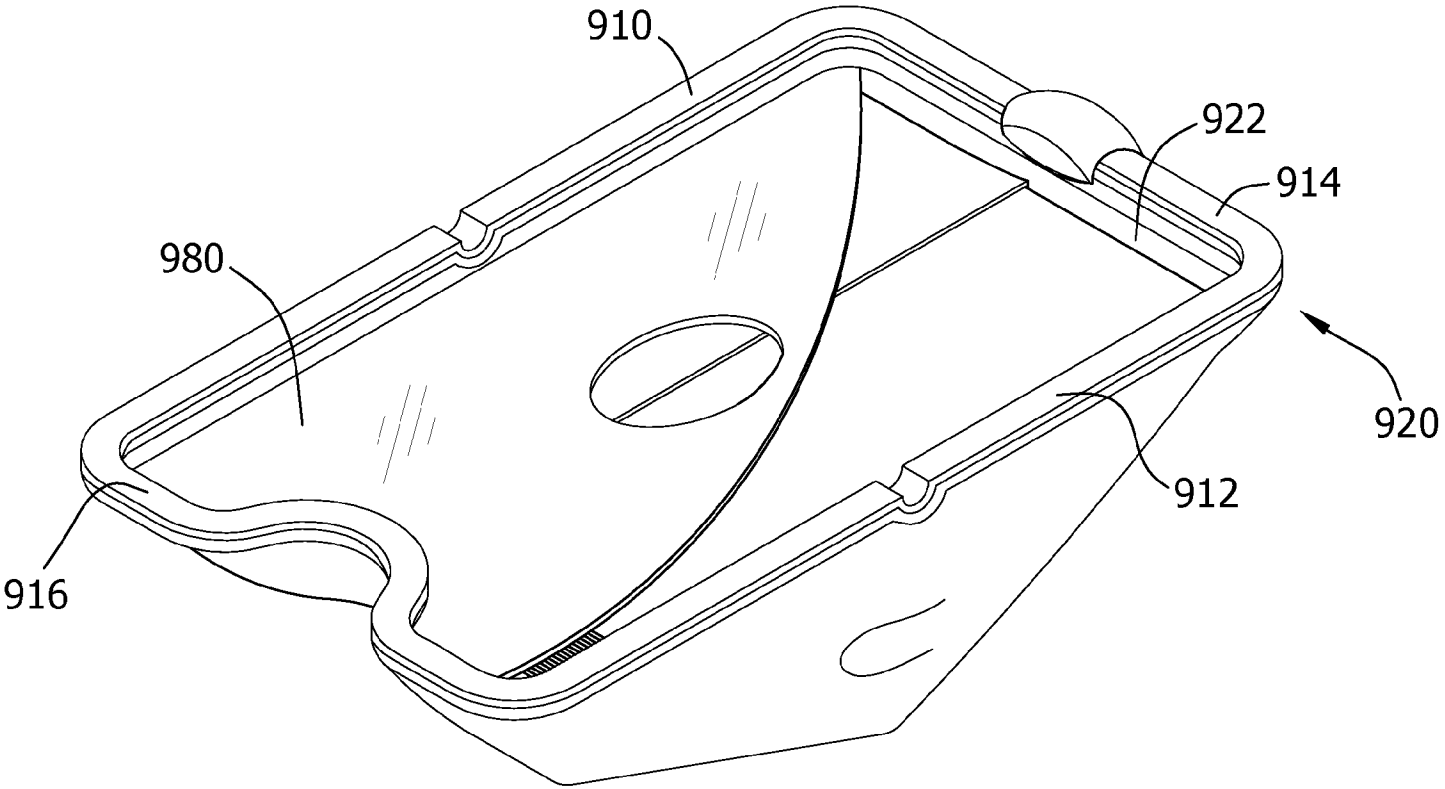
FIG. 10*a* is a view of a tenth representative embodiment of a dispenser of the present disclosure.
Figure 10B:
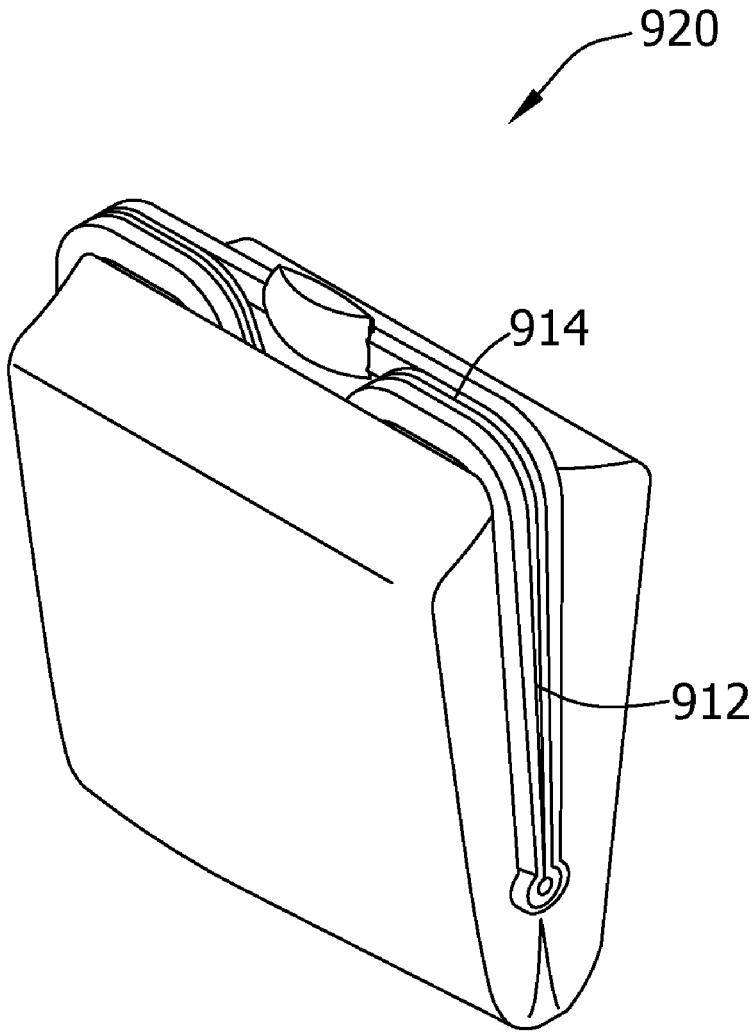
FIG. 10*b* is a view of the dispenser in FIG. 10*a* in a closed (i.e., folded) position.

In yet another embodiment, as shown in FIGS. 10*a* and 10*b*, the lid 980 encloses three-quarters of the internal compartment 922 of the container 920 and is diagonally configured so as to be in direct contact with a first lateral edge 910 and a first longitudinal edge 916.

It should be recognized that when the container includes a rigid external rim as described more fully above, the lid, in any of the above embodiments, contacts the corresponding edges of the external rim of the container.

Furthermore, it should be noted by one skilled in the art that the lid does not necessarily have to be a separate component. Specifically, in one embodiment, an extension of the container material is molded to the external rim to enclose the internal compartment of the container; that is, the container material is physically attached at least partially to the rim. The material may be physically attached using any means in the art, such as, for example, adhesive, heat sealed, and the like.

Furthermore, as shown in FIGS. 7*a*, 7*b*, 8*a*, 9 and 10*a* and described above, the lid may further include a dispensing opening for dispensing the personal care product from the internal compartment of the container when the container is in an open position and the lid is down. Specifically, for example, in FIG. 7*a*, the lid 680 includes a dispensing opening 690 which is a curved slit opening in the center of the lid 680 for dispensing the personal care product. In another example, shown in FIG. 8*a*, the lid 780 includes a permanent circular dispensing opening 790 for dispensing the product. While the above configurations for the dispensing opening in the lid are shown, it should be recognized by one skilled in the art that the dispensing opening can be any size or shape so as to consistently dispense a personal care product from the internal compartment of the container without removing the lid.

Moreover, in one particularly preferred embodiment, the lid further may comprise a fastening component capable of releasably fastening the lid to the edges of the container. The fastening component for the lid can be similar to the fastening component as described above for the cross bar of FIG. 3*b*.

Having described the invention in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description and shown in the accompanying drawings shall be interpreted as illustrative and not in a limiting sense.

What is claimed is:

1. A dispenser comprising:

a container having an internal compartment and at least one hinge for folding the container between an opened position and a closed position, wherein the container comprises a rigid external rim that substantially surrounds the internal compartment of the container when in the open position, the rigid external rim being defined by a pair of lateral edges and a pair of longitudinal edges, the at least one hinge being formed in at least one of the lateral edges, and a latching device being disposed on at least one of the longitudinal edges, the container being moveable from an opened position to a closed position by folding the container generally in half about the at least one hinge; and a personal care product disposed within the internal compartment of the container, the container being configured to permit removal of the personal care product from the internal compartment when in the opened position, the personal care product being folded about a transverse fold line in the closed position of the container, the personal care product being unfolded about the transverse fold line in the opened position of the container, the transverse fold line being generally coaxial with the at least one hinge of the container.

2. The dispenser as set forth in claim 1 wherein the latching device is configured for holding the container in the closed position.

3. The dispenser as set forth in claim 1 wherein the at least one hinge and the transverse fold line about which the personal care article is folded and unfolded is generally coaxial with a transverse axis of the container and a transverse axis of the personal care article.

4. The dispenser as set forth in claim 1 further comprising at least one clip for securing the personal care article within the interior compartment of the container.

5. The dispenser as set forth in claim 1 wherein the personal care article comprises a wet wipe.

6. A dispenser comprising:

a container having an internal compartment for holding a personal care product and an external rim surrounding the internal compartment, the external rim being defined by a pair of lateral edges and a pair of longitudinal edges, a first hinge being disposed on one of the lateral edges, a second hinge being disposed on the other lateral edge, and a latching device being disposed on at least one of the longitudinal edges, the container being moveable from an opened position to a closed position by folding the container generally in half about the first and second hinges, the latching device being configured to hold the container in the closed position;

a personal care product disposed within the internal compartment of the container in a full, flat orientation when the container is in the open position, the container being configured to permit removal of the personal care product from the internal compartment when in the open position.

* * * * *